US010731101B2

(12) United States Patent
Delamore et al.

(10) Patent No.: US 10,731,101 B2
(45) Date of Patent: Aug. 4, 2020

(54) LUBRICATING OIL COMPOSITIONS

(71) Applicant: Infineum International Limited, Abingdon (GB)

(72) Inventors: Oliver J. Delamore, Abingdon (GB); Nigel A. Male, Salisbury (GB); Alastair A. Cant, Didcot (GB); Philip J. Woodward, Reading (GB)

(73) Assignee: INFINEUM INTERNATIONAL LIMITED, Abingdon, Oxfordshire (GB)

( * ) Notice: Subject to any disclaimer, the term of this patent is extended or adjusted under 35 U.S.C. 154(b) by 0 days.

(21) Appl. No.: 16/158,376

(22) Filed: Oct. 12, 2018

(65) Prior Publication Data

US 2019/0112545 A1 Apr. 18, 2019

(30) Foreign Application Priority Data

Oct. 12, 2017 (EP) ..... 17196225

(51) Int. Cl.

| | |
|---|---|
| ***C10M 169/04*** | (2006.01) |
| ***C10M 135/06*** | (2006.01) |
| ***C10M 127/02*** | (2006.01) |
| ***C10M 135/18*** | (2006.01) |
| ***C10M 141/08*** | (2006.01) |

(52) U.S. Cl.

CPC ..... *C10M 169/04* (2013.01); *C10M 127/02* (2013.01); *C10M 135/06* (2013.01); *C10M 135/18* (2013.01); *C10M 141/08* (2013.01); *C10M 2203/003* (2013.01); *C10M 2203/024* (2013.01); *C10M 2205/026* (2013.01); *C10M 2219/02* (2013.01); *C10M 2219/022* (2013.01); *C10M 2219/024* (2013.01); *C10M 2219/068* (2013.01); *C10N 2230/10* (2013.01); *C10N 2230/12* (2013.01); *C10N 2230/36* (2013.01); *C10N 2240/10* (2013.01); *C10N 2240/102* (2013.01); *C10N 2240/104* (2013.01)

(58) Field of Classification Search

CPC combination set(s) only.
See application file for complete search history.

(56) References Cited

U.S. PATENT DOCUMENTS 4,664,825 A * 5/1987 Walsh ..... C07G 17/006 252/406

FOREIGN PATENT DOCUMENTS

| | | |
|---|---|---|
| EP | 0107282 A2 | 5/1984 |
| WO | 9604355 A1 | 2/1996 |

* cited by examiner

*Primary Examiner* — Ellen M Mcavoy
*Assistant Examiner* — Chantel L Graham

(57) ABSTRACT

A lubricating oil composition which comprises a sulphur containing anti-oxidant and an alkene which exhibits improved nitrile elastomer seal compatibility.

14 Claims, No Drawings

LUBRICATING OIL COMPOSITIONS

FIELD OF THE INVENTION

The present invention relates to lubricating oil compositions for automotive engines (automotive lubricating oil compositions), especially crankcase lubricating oil compositions. More specifically, although not exclusively, the present invention relates to crankcase lubricating oil compositions (crankcase lubricants) for use in gasoline (spark-ignited) and diesel (compression-ignited) internal combustion engines. In particular, the present invention relates to such lubricating oil compositions that include a sulphur containing additive component, such as a sulphur containing anti-oxidant additive component, which typically exhibit improved nitrile elastomer seal compatibility performance when used to lubricate an automotive engine. The invention also relates to, although not exclusively, such lubricating oil compositions that include a sulphur containing additive component, such as a sulphur containing anti-oxidant component, that exhibit improved copper corrosion performance and/or lead corrosion performance when used to lubricate an automotive engine. Furthermore, the invention also relates to the use of alkene(s), as an additive component, in such lubricating oil compositions that include a sulphur containing additive component, especially a sulphur containing anti-oxidant component, to mitigate incompatibility with nitrile elastomer seal(s) associated with the sulphur containing additive component, and/or to mitigate copper corrosion and/or to mitigate lead corrosion, associated with the sulphur containing additive component, when the lubricating oil composition is used to lubricate an engine; such an improvement in nitrite seal compatibility performance and/or copper corrosion performance and/or lead corrosion performance is typically achievable whilst substantially maintaining the anti-oxidancy performance of the lubricant (i.e. without substantially affecting the efficacy of the sulphur containing anti-oxidant additive component).

BACKGROUND OF THE INVENTION

Lubricating oil compositions for automotive engines (e.g. crankcase lubricants) include additives to enhance the performance characteristics of the lubricant which is typically required by the consumer and by engine manufacturers before certifying the use of a particular lubricant in their engine(s). However, concurrent with the desire to enhance performance characteristics of the lubricant, there has been a continued effort to reduce the content of sulphated ash, phosphorus and sulphur in the lubricant due to both environmental concerns and to insure compatibility with pollution control devices (e.g. catalytic converters and particulate traps).

There are many types of lubricating oil composition additives used to enhance engine performance. Whilst a particular additive may exhibit benefits in one aspect of engine performance that same additive may also exhibit detrimental effects in another aspect. Sulphur containing compounds have been considered as alternative and supplemental additive components in lubricants, especially for their anti-oxidancy performance properties, but these sulphur containing compounds have been used with limited and varying degrees of success, primarily due to the sulphur content of such compounds and the introduction of sulphur into the lubricant, their association with copper corrosion and/or lead corrosion (especially copper corrosion), and their poor compatibility with nitrile elastomer seals which are present in modern internal combustion engines and transmissions. Before certifying a lubricant for use in their engine(s), engine manufacturers (often referred to as "OEMs") require the lubricant passes a number of performance tests, including tests for compatibility with nitrile elastomer seals, copper and lead corrosion tests.

Accordingly, the present invention aims to provide a lubricating oil composition (especially a lubricating oil composition for an automotive internal combustion engine) that includes a sulphur containing additive component, preferably a sulphur containing anti-oxidant additive component, which, in use, exhibits improved compatibility with nitrile elastomer seals, preferably without significantly compromising the anti-oxidancy performance associated with the sulphur containing additive. The present invention also aims to provide a lubricating oil composition that includes a sulphur containing additive compound, preferably a sulphur containing anti-oxidant additive, wherein the lubricating oil composition exhibits improved copper corrosion and/or lead corrosion performance characteristic(s), especially copper corrosion performance characteristics, preferably without significantly compromising the anti-oxidancy performance associated with the sulphur containing additive.

SUMMARY OF THE INVENTION

In accordance with a first aspect, the present invention provides a lubricating oil composition which comprises or is made by admixing:

(A) an oil of lubricating viscosity, in a major amount;

(B) one or more oil-soluble or oil dispersible sulphur containing anti-oxidant(s), as an additive in an effective minor amount providing the lubricating oil composition with greater than or equal to 0.01 mass % sulphur; and, (C) one or more oil-soluble or oil-dispersible alkene(s) having greater than or equal to 10 carbon atoms, as an additive in an effective minor amount.

Preferably, the lubricating oil composition of the present invention is a crankcase lubricant for an internal combustion engine. Suitably, the lubricating oil composition of the present invention is suitable for lubricating gasoline (spark-ignited) and diesel (compression-ignited) internal combustion engines.

Unexpectedly, it has been found that the one or more oil-soluble or oil-dispersible alkene(s) having greater than or equal to 10 carbon atoms (C) (preferably 12 or more carbon atoms), as defined herein, may be used as an additive in an effective minor amount, in a lubricating oil composition comprising an oil of lubricating viscosity in a major amount and one or more oil-soluble or oil-dispersible sulphur containing anti-oxidant(s) (B), as defined herein, as an additive in an effective minor amount, to improve the compatibility of the lubricating oil composition with nitrile elastomer seals which are present in modern internal combustion engines. Moreover, the improvement in nitrile elastomer seal compatibility is typically achievable whilst maintaining substantially the anti-oxidancy performance characteristics of the lubricating oil composition and/or the sulphur containing anti-oxidant additive (B) (i.e. substantially without detriment to the efficacy of the sulphur containing anti-oxidant additive). Accordingly, it has been found that the one or more oil-soluble or oil-dispersible alkene(s) having greater than or equal to 10 carbon atoms (C) (preferably 12 or more carbon atoms), as defined herein, may be used as an additive in a lubricating composition, in an effective minor amount, to prevent and/or inhibit incompatibility between nitrile elastomer seals and a sulphur containing anti-oxidant additive (B), as defined herein, yet substantially preserving the anti-oxidancy performance associated with the sulphur containing anti-oxidant additive (B), when the lubricating oil composition is used to lubricate an engine, particularly an internal combustion engine.

Additionally, it has also been found that the one or more oil-soluble or oil-dispersible alkene(s) having greater than or equal to 10 carbon atoms (C) (preferably 12 or more carbon atoms), as defined herein, may be used as an additive in an effective minor amount in a lubricating oil composition comprising an oil of lubricating viscosity in a major amount and one or more oil-soluble or oil-dispersible sulphur containing anti-oxidant(s) (B), as defined herein, as an additive in an effective minor amount, to reduce and/or inhibit copper and/or lead, especially copper, corrosion associated with such a lubricating oil composition. Moreover, such an improvement in anti-corrosion performance is typically achievable whilst maintaining substantially the anti-oxidancy performance characteristics of the lubricating oil composition and/or the sulphur containing anti-oxidant additive (B) (i.e. substantially without detriment to the efficacy of the sulphur containing antioxidant additive). Accordingly, it has been found that the one or more oil-soluble or oil-dispersible alkene(s) having greater than or equal to 10 carbon atoms (C) (preferably 12 or more carbon atoms), as defined herein, may be used as an additive in a lubricating composition, in an effective minor amount, to prevent and/or inhibit copper and/or lead, especially copper, corrosion associated with a sulphur containing anti-oxidant additive (B), as defined herein, yet substantially preserve the anti-oxidancy performance of the sulphur containing anti-oxidant additive (B), when the lubricating oil composition is used to lubricate an engine, particularly an internal combustion engine.

In accordance with a second aspect, the present invention provides a method of lubricating a spark-ignited or compression-ignited internal combustion engine comprising lubricating the engine with a lubricating oil composition as defined in accordance with the first aspect of the present invention. Preferably, the spark-ignited or compression-ignited internal combustion engine is an automotive internal combustion engine.

In accordance with a third aspect, the present invention provides the use, in the lubrication of a spark-ignited or compression-ignited internal combustion engine, of one or more oil-soluble or oil-dispersible alkene(s) having greater than or equal to 10 carbon atoms (C) (preferably 12 or more carbon atoms), as defined herein, as an additive in an effective minor amount, in a lubricating oil composition comprising an oil of lubricating viscosity in a major amount and one or more oil-soluble or oil-dispersible sulphur containing antioxidant(s) (B), as defined herein, as an additive in an effective minor amount, to improve the compatibility of the lubricating oil composition with nitrile elastomer seals present in the internal combustion engine (e.g. during operation of the engine).

In accordance with a fourth aspect, the present invention provides the use, in the lubrication of a spark-ignited or compression-ignited internal combustion engine, of one or more oil-soluble or oil-dispersible alkene(s) having greater than or equal to 10 carbon atoms (C) (preferably 12 or more carbon atoms), as defined herein, as an additive in an effective minor amount, in a lubricating oil composition comprising an oil of lubricating viscosity in a major amount and one or more oil-soluble or oil-dispersible sulphur containing anti-oxidant(s) (B), as defined herein, as an additive in an effective minor amount, to prevent and/or inhibit incompatibility associated with the sulphur containing anti-oxidant additive (B) and nitrile elastomer seals present in the internal combustion engine (e.g. during operation of the engine).

In accordance with a fifth aspect, the present invention provides the use, in the lubrication of a spark-ignited or compression-ignited internal combustion engine, of one or more oil-soluble or oil-dispersible alkene(s) having greater than or equal to 10 carbon atoms (C) (preferably 12 or more carbon atoms), as defined herein, as an additive in an effective minor amount, in a lubricating oil composition comprising an oil of lubricating viscosity in a major amount and one or more oil-soluble or oil-dispersible sulphur containing anti-oxidant(s) (B), as defined herein, as an additive in an effective minor amount, to reduce and/or inhibit copper corrosion of the lubricating oil composition (e.g. during operation of the engine).

In accordance with a sixth aspect, the present invention provides the use, in the lubrication of a spark-ignited or compression-ignited internal combustion engine, of one or more oil-soluble or oil-dispersible alkene(s) having greater than or equal to 10 carbon atoms (C) (preferably 12 or more carbon atoms), as defined herein, as an additive in an effective minor amount, in a lubricating oil composition comprising an oil of lubricating viscosity in a major amount and one or more oil-soluble or oil-dispersible sulphur containing anti-oxidant(s) (B), as defined herein, as an additive in an effective minor amount, to reduce and/or inhibit copper corrosion associated with the sulphur containing anti-oxidant additive (B) (e.g. during operation of the engine).

In accordance with a seventh aspect, the present invention provides the use, in the lubrication of a spark-ignited or compression-ignited internal combustion engine, of one or more oil-soluble or oil-dispersible alkene(s) having greater than or equal to 10 carbon atoms (C) (preferably 12 or more carbon atoms), as defined herein, as an additive in an effective minor amount, in a lubricating oil composition comprising an oil of lubricating viscosity in a major amount and one or more oil-soluble or oil-dispersible sulphur containing anti-oxidant(s) (B), as defined herein, as an additive in an effective minor, to reduce and/or inhibit lead corrosion of the lubricating oil composition (e.g. during operation of the engine).

In accordance with an eighth aspect, the present invention provides the use, in the lubrication of a spark-ignited or compression-ignited internal combustion engine, of one or more oil-soluble or oil-dispersible alkene(s) having greater than or equal to 10 carbon atoms (C) (preferably 12 or more carbon atoms), as defined herein, as an additive in an effective minor amount, in a lubricating oil composition comprising an oil of lubricating viscosity in a major amount and one or more oil-soluble or oil-dispersible sulphur containing anti-oxidant(s) (B), as defined herein, as an additive in an effective minor amount, to reduce and/or inhibit lead corrosion associated with the sulphur containing anti-oxidant additive (B) (e.g. during operation of the engine).

Suitably, the use of the one or more oil-soluble or oil-dispersible alkene(s) having greater than or equal to 10 carbon atoms (C) (preferably 12 or more carbon atoms), as defined herein, in the lubricating oil composition(s) of the first aspect of the invention and as defined in the second to eighth aspects of the invention, typically does not significantly affect the anti-oxidancy performance characteristics of the sulphur containing anti-oxidant (B) (i.e. the anti-oxidancy performance associated with the sulphur containing anti-oxidant is substantially preserved). Accordingly, in each independent use of the third to eighth aspects of the present invention, in the method according to the second aspect of the invention and in the lubricating oil composition of the first aspect of the invention, the anti-oxidancy performance of the one or more oil-soluble or oil-dispersible sulphur containing anti-oxidant(s) (B) and/or the anti-oxidancy performance of the lubricating oil composition is typically substantially maintained (i.e. substantially unaffected), despite the inclusion of the one or more oil-soluble or oil-dispersible alkene(s) having greater than or equal to 10 carbon atoms (C) (preferably 12 or more carbon atoms), as defined herein, as an additive component in the lubricating oil composition.

Suitably, each of the lubricating oil compositions as defined in the third to eighth aspects of the invention may each independently include the one or more sulphur containing anti-oxidant(s) (B), as defined herein, in an amount to provide the lubricating oil composition with greater than or equal to 0.01 mass % sulphur.

Preferably, the one or more oil-soluble or oil-dispersible sulphur containing anti-oxidant(s) is selected from: one or more sulfurized ($C_4$ to $C_{25}$) olefin(s); one or more sulphur containing phenolic anti-oxidant(s); one or more sulfurized aliphatic ($C_7$ to $C_{29}$) hydrocarbyl fatty acid ester(s); one or more sulphur containing molybdenum compound(s); and, combinations thereof. Highly preferred one or more sulphur containing anti-oxidant(s) is one or more sulfurized aliphatic ($C_7$ to $C_{29}$) hydrocarbyl fatty acid ester(s); one or more sulphur containing molybdenum compound(s); and, combinations thereof. Especially preferred are one or more sulfurized aliphatic ($C_7$ to $C_{29}$) hydrocarbyl fatty acid ester(s).

Preferably, the lubricating oil composition(s) of the first aspect of the present invention and as defined in the second to eighth aspects of the present invention may each independently include the one or more sulphur containing anti-oxidant(s) (B) in an amount to provide the lubricating oil composition with greater than or equal to 0.01, more preferably greater than or equal to 0.02, even more preferably greater than or equal to 0.03, even more preferably greater than or equal to 0.04, mass % sulphur, based on the total mass of the lubricating oil composition. Preferably, the lubricating oil composition(s) of the first aspect of the present invention and as defined in the second to eighth aspects of the present invention may each independently include the one or more sulphur containing anti-oxidant(s) (B) in an amount to provide the lubricating oil composition with less than or equal to 0.5, more preferably less than or equal to 0.4, even more preferably less than or equal to 0.3, even more preferably less than or equal to 0.2, even more preferably less than or equal to 0.15, mass % sulphur, based on the total mass of the lubricating oil composition. Suitably, the lubricating oil composition(s) of the first aspect of the present invention and as defined in the second to eighth aspects of the present invention may each independently include the one or more sulphur containing anti-oxidant(s) (B) in an amount to provide the lubricating oil composition with from 0.02 to 0.2, preferably from 0.02 to 0.15, even more preferably 0.02 to 0.1, even more preferably 0.04 to 0.1, mass % sulphur based on the total mass of the lubricating oil composition.

Preferably, the lubricating oil composition(s) of the first aspect of the present invention and as defined in the second to eighth aspects of the present invention may each independently include the one or more oil-soluble or oil-dispersible alkene(s) having greater than or equal to 10 carbon atoms (C) (preferably 12 or more carbon atoms) in an amount of greater than or equal to 0.01, more preferably greater than or equal to 0.03, even more preferably greater than or equal to 0.05, even more preferably greater than or equal to 0.07, even more preferably greater than or equal to 0.10, even more preferably greater than or equal to 0.15, even more preferably greater than or equal to 0.20, mass % based on the total mass of the lubricating oil composition. Preferably, the lubricating oil composition(s) of the first aspect of the present invention and as defined in the second to eighth aspects of the present invention may each independently include the one or more oil-soluble or oil-dispersible alkene(s) having greater than or equal to 10 carbon atoms (C) (preferably 12 or more carbon atoms) in an amount of less than or equal to 7.5, more preferably less than or equal to 5.0, more preferably less than or equal to 4.0, even more preferably less than or equal to 3.0, even more preferably less than or equal to 2.0, even more preferably less than or equal to 1.5, mass % based on the total mass of the lubricating oil composition. Suitably, the lubricating oil composition(s) of the first aspect of the present invention and as defined in the second to eighth aspects of the present invention may each independently include the one or more oil-soluble or oil-dispersible alkene(s) having greater than or equal to 10 carbon atoms (C) (preferably 12 or more carbon atoms) in an amount of from 0.05 to 3.0, preferably 0.1 to 2.0, more preferably 0.2 to 1.5, mass % based on the total mass of the lubricating oil composition.

The lubricating oil composition of the first aspect of the present invention and as defined in the second, third, fourth, fifth, sixth, seventh and eighth aspects of the present invention may each independently further include one or more oil-soluble or oil-dispersible non-sulphur containing ashless anti-oxidant(s) (D), as an additive in an effective minor amount. Preferably, the one or more non-sulphur containing ashless anti-oxidant(s) comprises an aminic antioxidant, such as an aromatic amine anti-oxidant, a phenolic anti-oxidant, such as a hindered phenol ester, or a combination thereof. If present, the one or more non-sulphur containing ashless antioxidant(s) (D) preferably includes an aromatic amine anti-oxidant. Preferably, if present, the one or more non-sulphur containing ashless anti-oxidant(s) (D), or total amount of such anti-oxidants, is present in an amount of 0.1 to 5.0, preferably 0.25 to 3.0, mass %, based on the total mass of the lubricating oil composition.

Preferably, the lubricating oil composition(s) of the first aspect of the present invention and as defined in the second, third, fourth, fifth, sixth, seventh and eighth aspects of the present invention may each independently further include one or more dihydrocarbyl dithiophosphate metal salt(s) (E) (e.g. ZDDP(s)), as an additive component in an effective minor amount. Suitably, if present, the one or more dihydrocarbyl dithiophosphate metal salt(s) (e.g. ZDDP(s)) is added to the lubricating oil composition(s) in amounts sufficient to provide no greater than 1200 ppm, preferably no greater than 1000 ppm, more preferably no greater than 900 ppm, most preferably no greater than 850 ppm of phosphorous, based on the total mass of the lubricating oil composition, and as measured in accordance with ASTM D5185. Suitably, if present, the one or more dihydrocarbyl dithiophosphate metal salt(s) (e.g. ZDDP(s)) is added to the lubricating oil composition(s) in amounts sufficient to provide at least 100 ppm, preferably at least 350 ppm, more preferably at least 500 ppm of phosphorous, based on the total mass of the lubricating oil composition, and as measured in accordance with ASTM D5185. It will be appreciated that although dihydrocarbyl dithiophosphate metal salt(s) (E) may exhibit anti-oxidant activity such compounds are not regarded as sulphur containing anti-oxidant (s) (B) within the context of the present invention.

Preferably, the lubricating oil composition(s) of the first aspect of the present invention and as defined in the second, third, fourth, fifth, sixth, seventh and eighth aspects of the present invention may each independently further include one or more ashless dispersant(s) (F). Preferably, the one or more ashless dispersant(s) comprises one or more nitrogen containing ashless dispersant(s), more preferably one or more polalkenyl succinimide dispersant(s), most preferably one or more polyisobutenyl succinimide dispersant(s). Suitably, if present, the one or more ashless dispersant(s) is present in an amount of from 0.1 to 20, preferably 1 to 15, more preferably 2 to 10, mass %, based on the total mass of the lubricating oil composition. Suitably, if present, the one or more nitrogen containing ashless dispersant(s) provides the lubricating oil composition(s) with up to 0.20, preferably up to 0.15, more preferably up to 0.10, mass % nitrogen, based on the total mass of the composition and as measured according to ASTM method D5291. Suitably, if present, the one or more nitrogen containing ashless dispersant(s) provides the lubricating oil composition(s) with greater than or equal to 0.01, preferably greater than or equal to 0.02, more preferably greater than or equal to 0.03, mass % nitrogen, based on the total mass of the composition and as measured according to ASTM method D5291.

The one or more ashless dispersant(s), if present, may be comprise one or more borated ashless dispersant(s) providing the lubricating oil composition(s) with at least 10, such as at least 30, for example, at least 50 or even at least 70 ppm of boron, based on the total mass of the lubricating oil composition. If present, the borated ashless dispersant(s) suitably provides no more than 1000, preferably no more than 750, more preferably no more than 500 ppm of boron to the lubricating oil composition, based on the total mass of the lubricating oil composition.

Preferably, the lubricating oil composition of the first aspect of the present invention and as defined in the second, third, fourth, fifth, sixth, seventh and eighth aspects of the present invention may each independently further include one or more co-additives in an effective minor amount (e.g. 0.1 to 30 mass %), other than additive components (B) and (C), and optional additive components (D) to (F) if present, selected from metal detergents, corrosion inhibitors, antioxidants, pour point depressants, dispersants, antiwear agents, friction modifiers, demulsifiers, antifoam agents and viscosity modifiers.

Suitably, the lubricating oil composition of the first aspect of the present invention and as defined in the second, third, fourth, fifth, sixth, seventh and eighth aspects of the present invention each independently has a sulphated ash content of less than or equal to 1.2, preferably less than or equal to 1.1, more preferably less than or equal to 1.0, mass % (ASTM D874) based on the total mass of the composition.

Preferably, the lubricating oil composition of the first aspect of the present invention and as defined in the second, third, fourth, fifth, sixth, seventh and eighth aspects of the present invention each independently contains low levels of phosphorus. Suitably, the lubricating oil composition(s) each independently contains phosphorus in an amount of less than or equal to 0.12, preferably less than or equal to 0.11, more preferably less than or equal to 0.10, even more preferably less than or equal to 0.09, even more preferably less than or equal to 0.08, most preferably less than or equal to 0.07, mass % of phosphorus (ASTM D5185) based on the total mass of the composition. Suitably, the lubricating oil composition(s) each independently contains phosphorus in an amount of greater than or equal to 0.01, preferably greater than or equal to 0.02, more preferably greater than or equal to 0.03, even more preferably greater than or equal to 0.05, mass % of phosphorus (ASTM D5185) based on the total mass of the composition.

Typically, the lubricating oil composition(s) may contain low levels of sulphur. Preferably, the lubricating oil composition of the first aspect of the present invention and as defined in the second, third, fourth, fifth, sixth, seventh and eighth aspects of the present invention each independently contain sulphur in an amount of up to 0.6, more preferably up to 0.5, even more preferably up to 0.4, even more preferably up to 0.3, even more preferably up to 0.2, mass % sulphur (ASTM D2622) based on the total mass of the composition.

Typically, the lubricating oil composition of the first aspect of the present invention and as defined in the second, third, fourth, fifth, sixth, seventh and eighth aspects of the present invention each independently contains up to 0.30, more preferably up to 0.20, most preferably up to 0.15, mass % nitrogen, based on the total mass of the composition and as measured according to ASTM method D5291.

Suitably, the lubricating oil composition of the first aspect of the present invention and as defined in the second, third, fourth, fifth, sixth, seventh and eighth aspects of the present invention each independently has a total base number (TBN), as measured in accordance with ASTM D2896, of from 4 to 15, preferably from 5 to 12 mg KOH/g.

In accordance with a preferred embodiment, the lubricating oil composition of the first aspect and as defined in the second to eighth aspects of the invention comprises or is made by admixing:

(A) an oil of lubricating viscosity, in a major amount;

(B) one or more oil-soluble or oil-dispersible sulphur containing anti-oxidant(s) selected from sulfurized $C_4$ to $C_{25}$ olefin(s), sulfurized aliphatic ($C_7$ to $C_{29}$) hydrocarbyl fatty acid ester(s), ashless sulfurized phenolic anti-oxidant(s), sulphur containing organo-molybdenum compound(s), and combinations thereof, as an additive in an effective minor amount providing the lubricating oil composition with greater than or equal to 0.01 mass % sulphur; and, (C) one or more oil-soluble or oil-dispersible $C_{10}$ to $C_{20}$, preferably $C_{12}$ to $C_{20}$, preferably $C_{12}$ to $C_{18}$, more preferably $C_{14}$ to $C_{18}$, alkene(s), as an additive in an effective minor amount of greater than or equal to 0.01 mass %, based on the total mass of the lubricating oil composition.

Preferably, the one or more oil-soluble or oil-dispersible sulphur containing anti-oxidant(s) (B) is selected from one or more sulfurized aliphatic ($C_7$ to $C_{29}$) hydrocarbyl fatty acid ester(s), one or more di- or tri-nuclear molybdenum dithiocarbamate, and combinations thereof, especially one or more sulfurized aliphatic ($C_7$ to $C_{29}$) hydrocarbyl fatty acid ester(s), as defined herein.

Preferably, the one or more oil-soluble or oil-dispersible $C_{10}$ to $C_{20}$ alkene(s) is one or more linear acyclic $C_{10}$ to $C_{20}$, more preferably one or more linear acyclic $C_{12}$ to $C_{20}$, even more preferably one or more linear acyclic $C_{12}$ to $C_{18}$, even more preferably one or more linear acyclic $C_{14}$ to $C_{18}$, alkene(s), especially the alk-1-ene(s). Highly preferred one or more oil-soluble or oil-dispersible $C_{10}$ to $C_{20}$ alkene(s) include dec-1-ene, dodec-1-ene, tetradec-1-ene, hexadec-1-ene, octadec-1-ene, and combinations thereof; especially dodec-1-ene, tetradec-1-ene, hexadec-1-ene, octadec-1-ene, and combinations thereof; even more especially tetradec-1-ene.

In this specification, the following words and expressions, if and when used, have the meanings given below:

"active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or any cognate word. The expression "consists essentially of" permits inclusion of substances not materially affecting the characteristics of the composition to which it applies. The expression "consists of" or cognates means only the stated features, steps, integers components or groups thereof are present to which the expression refers;

"hydrocarbyl" means a univalent chemical group (i.e. univalent radical) of a compound that contains hydrogen and carbon atoms and that group is bonded to the remainder of the compound directly via a carbon atom. The group may contain one or more atoms other than carbon and hydrogen provided they do not affect the essentially hydrocarbyl nature of the group. Those skilled in the art will be aware of suitable groups (e.g., halo, especially chloro and fluoro, amino, alkoxyl, mercapto, alkylmercapto, nitro, nitroso, sulfoxy, etc.). Preferably, the hydrocarbyl group consists essentially of hydrogen and carbon atoms, unless specified otherwise. More preferably, the hydrocarbyl group consists of hydrogen and carbon atoms, unless specified otherwise. Preferably, the hydrocarbyl group is a $C_1$ to $C_{30}$ hydrocarbyl group, more preferably an aliphatic hydrocarbyl group, such as a $C_1$ to $C_{30}$ aliphatic hydrocarbyl group. The term "hydrocarbyl" includes "alkyl", "alkenyl" and "aryl" as defined herein;

"hydrocarbon" means a chemical compound that contains hydrogen and carbon atoms and is otherwise defined as the term "hydrocarbyl";

"alkyl" means a $C_1$ to $C_{30}$ alkyl group, preferably a $C_1$ to $C_6$ alkyl group, which is bonded to the remainder of the compound directly via a single carbon atom. Unless otherwise specified, alkyl groups may, when there are a sufficient number of carbon atoms, be linear (i.e. unbranched) or branched, be cyclic, acyclic or part cyclic/acyclic. Preferably, the alkyl group comprises a linear or branched acyclic alkyl group. Representative examples of alkyl groups include, but are not limited to, methyl, ethyl, n-propyl, iso-propyl, n-butyl, sec-butyl, iso-butyl, tert-butyl, n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and triacontyl;

"alkenyl" means a $C_2$ to $C_{30}$, preferably a $C_2$ to $C_{12}$, group which includes at least one carbon to carbon double bond and is bonded to the remainder of the compound directly via a single carbon atom, and is otherwise defined as "alkyl";

"alkylene" is synonymous with "alkanediyl" and means a $C_2$ to $C_{20}$, preferably a $C_2$ to $C_{10}$, more preferably a $C_2$ to $C_6$ bivalent saturated acyclic aliphatic hydrocarbon radical derived from an alkane by removal of a hydrogen atom from two different carbon atoms; it may be linear or branched. Representative examples of alkylene include ethylene (ethanediyl), propylene (propanediyl), butylene (butanediyl), isobutylene, pentylene, hexylene, heptylene, octylene, nonylene, decylene, 1-methyl ethylene, 1-ethyl ethylene, 1-ethyl-2-methyl ethylene, 1,1-dimethyl ethylene and 1-ethyl propylene;

"poly(alkylene)" is synonymous with "poly(alkene)" and means a polymer containing the appropriate alkanediyl repeating group. Such polymers may be formed by polymerisation of the appropriate alkene (e.g. polyisobutylene may be formed by polymerising isobutene);

"aryl" means a $C_6$ to $C_{18}$, preferably $C_6$ to $C_{10}$, aromatic group, optionally substituted by one or more alkyl groups, halo, hydroxyl, alkoxy and amino groups, which is bonded to the remainder of the compound directly via a single carbon atom. Preferred aryl groups include phenyl and naphthyl groups and substituted derivatives thereof, especially phenyl and alkyl substituted derivatives thereof;

"alkene", which (C) represents, means a hydrocarbon compound that includes at least one carbon to carbon double bond and may, when there is a sufficient number of carbon atoms, be linear or branched, be cyclic, acylic or part cyclic/acyclic. Preferred alkene(s) include acyclic alkene(s), more preferably linear acyclic alkene(s). The term alkene includes all geometric and structural isomers. Highly preferred alkene compounds include compounds where the at least one carbon to carbon double bond represents the only functional group. Representative examples of alkenes having greater than or equal to 10 carbon atoms, which (C) represents include, but are not limited to, decene, undecene, dodecene, tridecene, tetradecene, pentadecene, hexadecane, heptadecene, octadecene, nonadecene, icosene, heneicosene, and docosene;

"monocarboxylic acid" means a hydrocarbyl monocarboxylic acid which includes a single carboxylic acid functional group;

"aliphatic hydrocarbyl fatty acid" means a monocarboxylic acid having an aliphatic $C_7$ to $C_{29}$, preferably a $C_9$ to $C_{27}$, most preferably a $C_{11}$ to $C_{23}$ hydrocarbyl chain. Such compounds may be referred to herein as aliphatic ($C_7$ to $C_{29}$), more preferably ($C_9$ to $C_{27}$), most preferably ($C_{11}$ to $C_{23}$), hydrocarbyl monocarboxylic acid(s) or hydrocarbyl fatty acid(s) (wherein $C_x$ to $C_y$ designates the total number of carbon atoms in the aliphatic hydrocarbyl chain of the fatty acid, the fatty acid itself due to the presence of the carboxyl carbon atom includes a total of $C_{x+1}$ to $C_{y+1}$ carbon atoms). Preferably, the aliphatic hydrocarbyl fatty acid, inclusive of the carboxyl carbon atom, has an even number of carbon atoms. The aliphatic hydrocarbyl chain of the fatty acid may be saturated or unsaturated (i.e. includes at least one carbon to carbon double bond); preferably, the aliphatic hydrocarbyl chain is unsaturated and includes at least one carbon to carbon double bond—such fatty acids may be obtained from natural sources (e.g. derived from animal or vegetable oils) and/or by reduction of the corresponding saturated fatty acid. It will be appreciated that a proportion of the aliphatic hydrocarbyl chain(s) of the corresponding aliphatic hydrocarbyl fatty acid ester(s) is unsaturated (i.e. includes at least one carbon to carbon double bond) to permit reaction with sulphur to form the corresponding sulfurized aliphatic hydrocarbyl fatty acid ester(s);

"aliphatic hydrocarbyl fatty acid ester" means an ester obtainable by convening the monocarboxylic acid functional group of the corresponding aliphatic hydrocarbyl fatty acid into an ester group. Suitably, the monocarboxylic acid functional group of the aliphatic hydrocarbyl fatty acid is converted to a hydrocarbyl ester, preferably a $C_1$ to $C_{30}$ aliphatic hydrocarbyl ester, such as an alkyl ester, preferably a $C_1$ to $C_6$ alkyl ester, especially a methyl ester. Alternatively, or additionally, the monocarboxylic acid functional group of the aliphatic hydrocarbyl fatty acid may be in the form of the natural glycerol ester. Accordingly, the term "aliphatic hydrocarbyl fatty acid ester" embraces aliphatic hydrocarbyl fatty acid glycerol ester(s) and aliphatic hydrocarbyl fatty acid $C_1$ to $C_{30}$ aliphatic hydrocarbyl ester(s), (e.g. aliphatic hydrocarbyl fatty acid alkyl ester(s), more preferably aliphatic hydrocarbyl fatty acid $C_1$ to $C_6$ alkyl ester(s), especially aliphatic hydrocarbyl fatty acid methyl ester(s)). Suitably, the term "aliphatic hydrocarbyl fatty acid ester" embraces aliphatic ($C_7$ to $C_{29}$) hydrocarbyl, more preferably aliphatic ($C_9$ to $C_{27}$) hydrocarbyl, most preferably aliphatic ($C_{11}$ to $C_{23}$) hydrocarbyl fatty acid glycerol ester(s) and aliphatic ($C_7$ to $C_{29}$) hydrocarbyl, more preferably aliphatic ($C_9$ to $C_{27}$) hydrocarbyl, most preferably aliphatic ($C_{11}$ to $C_{23}$) hydrocarbyl fatty acid $C_1$ to $C_{30}$ aliphatic hydrocarbyl ester(s). Suitably, to permit sulfurization of the aliphatic hydrocarbyl fatty acid ester(s) a proportion of the aliphatic hydrocarbyl chain(s) of the fatty acid ester(s) is unsaturated and includes at least one carbon to carbon double bond;

"sulfurized aliphatic hydrocarbyl fatty acid ester" means a compound obtained by sulphurizing an aliphatic hydrocarbyl fatty acid ester as defined herein. Suitably, the sulfurized aliphatic hydrocarbyl fatty acid ester(s) is ashless;

"halo" or "halogen" includes fluoro, chloro, bromo and iodo;

"oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stablely dispersible in oil to an extent sufficient to exert their intended effect in the environment in which the oil is employed. Moreover, the additional incorporation of other additives may also permit incorporation of higher levels of a particular additive, if desired;

"ashless" in relation to an additive means the additive does not include a metal;

"ash-containing" in relation to an additive means the additive includes a metal;

nitrile seal compatibility is measured using the Mercedes Benz Seals Test in accordance with VDA 675 301;

copper and/or lead corrosion performance is measured using the High Temperature Corrosion Bench Test (HTCBT) in accordance with ASTM D6594-06;

anti-oxidancy performance is measured using the modified Sequence IIIG Engine Test (ASTM D7320-07) as described herein;

"major amount" means in excess of 50 mass % of a composition expressed in respect of the stated component and in respect of the total mass of the composition, reckoned as active ingredient of the component;

"minor amount" means less than 50 mass % of a composition, expressed in respect of the stated additive and in respect of the total mass of the composition, reckoned as active ingredient of the additive;

"effective minor amount" in respect of an additive means a minor amount of such an additive in the composition so that the additive that is effective to provide, and provides, the desired technical effect;

"ppm" means parts per million by mass, based on the total mass of the lubricating oil composition;

"metal content" of the lubricating oil composition or of an additive component, for example molybdenum content or total metal content of the lubricating oil composition (i.e. the sum of all individual metal contents), is measured by ASTM D5185;

$M_n$ means number average molecular weight and for polymeric entities may be determined by gel permeation chromatography;

$M_w$ means weight average molecular weight and for polymeric entities may be determined by gel permeation chromatography;

"TBN" in relation to an additive component or of a lubricating oil composition of the present invention, means total base number (mg KOH/g) as measured by ASTM D2896;

"$KV_{40}$" means kinematic viscosity at 40° C. as measured by ASTM D445;

"$KV_{100}$" means kinematic viscosity at 100° C. as measured by ASTM D445;

"phosphorus content" is measured by ASTM D5185;

"sulphur content" is measured by ASTM D2622; and,

"sulfated ash content" is measured by ASTM D874.

All percentages reported are mass % on an active ingredient basis, i.e. without regard to carrier or diluent oil, unless otherwise stated.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined. Accordingly, any upper and lower quantity, range and ratio limits set forth herein associated with a particular technical feature of the present invention may be independently combined with any upper and lower quantity, range and ratio limits set forth herein associated with one or more other particular technical feature(s) of the present invention. Furthermore, any particular technical feature of the present invention, and all preferred variants thereof, may be independently combined with any other particular technical feature(s), and all preferred variants thereof.

Also, it will be understood that the preferred features of each aspect of the present invention are regarded as preferred features of every other aspect of the present invention.

DETAILED DESCRIPTION OF THE INVENTION

The features of the invention relating, where appropriate, to each and all aspects of the invention, will now be described in more detail as follows:

Oil of Lubricating Viscosity (A)

The oil of lubricating viscosity (sometimes referred to as "base stock" or "base oil") is the primary liquid constituent of a lubricant, into which additives and possibly other oils are blended, for example to produce a final lubricant (or lubricant composition). A base oil is useful for making concentrates as well as for making lubricating oil compositions therefrom, and may be selected from natural (vegetable, animal or mineral) and synthetic lubricating oils and mixtures thereof.

The base stock groups are defined in the American Petroleum Institute (API) publication "Engine Oil Licensing and Certification System", Industry Services Department, Fourteenth Edition, December 1996, Addendum 1, December 1998. Typically, the base stock will have a viscosity preferably of 3-12, more preferably 4-10, most preferably 4.5-8, $mm^2/s$ (cSt) at 100° C.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.
b) Group II base stocks contain greater than or equal to 90 percent saturates and less than or equal to 0.03 percent sulphur and have a viscosity index greater than or equal to 80 and less than 120 using the test methods specified in Table E-1.
c) Group III base stocks contain greater than or equal to 90 percent saturates and less than or equal to 0.03 percent sulphur and have a viscosity index greater than or equal to 120 using the test methods specified in Table E-1.
d) Group IV base stocks are polyalphaolefins (PAO).
e) Group V base stocks include all other base stocks not included in Group I, II, III, or IV.

TABLE E-1

Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

Other oils of lubricating viscosity which may be included in the lubricating oil composition are detailed as follows:

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Other examples of base oil are gas-to-liquid ("GTL") base oils, i.e. the base oil may be an oil derived from Fischer-Tropsch synthesised hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

Whilst the composition of the base oil will depend upon the particular application of the lubricating oil composition and the oil formulator will chose the base oil to achieve desired performance characteristics at reasonable cost, the base oil of a lubricating oil composition according to the present invention typically comprises no more than 85 mass % Group IV base oil, the base oil may comprise no more than 70 mass % Group IV base oil, or even no more than 50 mass % Group IV base oil. The base oil of a lubricating oil composition according to the present invention may comprise 0 mass % Group IV base oil. Alternatively, the base oil of a lubricating oil composition according to the present invention may comprise at least 5 mass %, at least 10 mass % or at least 20 mass % Group IV base oil. The base oil of a lubricating oil composition according to the present invention may comprise from 0 to 85 mass %, or from 5-85 mass %, alternatively from 10-85 mass % Group IV base oil.

Preferably, the volatility of the oil of lubricating viscosity or oil blend, as measured by the NOACK test (ASTM D5800), is less than or equal to 20%, preferably less than or equal to 16%, preferably less than or equal to 12%, more preferably less than or equal to 10%.

Preferably, the viscosity index (VI) of the oil of lubricating viscosity is at least 90, more preferably at least 95, even more preferably at least 110, even more preferably up to 120, even more preferably at least 120, even more preferably at least 125, most preferably from about 130 to 140.

Preferably, the oil of lubricating viscosity contains less than 0.03 percent sulphur.

Preferably, the oil of lubricating viscosity (excluding any diluent oil introduced by the use of an additive concentrate) comprises a Group II basestock, a Group III basestock, or a combination thereof. Most preferably, the oil of lubricating viscosity (excluding any diluent oil introduced by the use of an additive concentrate) consists essentially of a Group III basestock.

The oil of lubricating viscosity is provided in a major amount, in combination with minor amounts of additive components (B) and (C), as defined herein and, if necessary, one or more co-additives, such as described hereinafter, constituting a lubricating oil composition. This preparation may be accomplished by adding the additives directly to the oil or by adding them in the form of a concentrate thereof to disperse or dissolve the additive. Additives may be added to the oil by any method known to those skilled in the art, either before, at the same time as, or after addition of other additives.

Preferably, the oil of lubricating viscosity is present in an amount of greater than 55 mass %, more preferably greater than 60 mass %, even more preferably greater than 65 mass %, based on the total mass of the lubricating oil composition. Preferably, the oil of lubricating viscosity is present in an amount of less than 98 mass %, more preferably less than 95 mass %, even more preferably less than 90 mass %, based on the total mass of the lubricating oil composition.

When concentrates are used to make the lubricating oil compositions, they may for example be diluted with 3 to 100, e.g. 5 to 40, parts by mass of oil of lubricating viscosity per part by mass of the concentrate.

Preferably, the lubricating oil composition is a multigrade oil identified by the viscometric descriptor SAE 20WX, SAE 15WX, SAE 10WX, SAE 5WX or SAE 0WX, where X represents any one of 20, 30, 40 and 50; the characteristics of the different viscometric grades can be found in the SAE J300 classification. In an embodiment of each aspect of the invention, independently of the other embodiments, the lubricating oil composition is in the form of an SAE 10WX, SAE 5WX or SAE 0WX, preferably in the form of a SAE 5WX or SAE 0WX, wherein X represents any one of 20, 30, 40 and 50. Preferably X is 20 or 30.

Sulphur Containing Anti-Oxidant (B)

The oil-soluble or oil-dispersible sulphur containing anti-oxidant additive may be one or more ashless sulphur containing anti-oxidant(s), ash-containing sulphur containing anti-oxidant(s), or a combination thereof.

Preferred ashless sulphur containing anti-oxidant(s) include sulfurized olefin(s), sulphur containing phenol(s), sulfurized aliphatic ($C_7$ to $C_{29}$) hydrocarbyl fatty acid ester(s), and combinations thereof. More preferred one or more ashless sulphur containing anti-oxidant(s) are sulfurized olefin(s), sulfurized aliphatic ($C_7$ to $C_{29}$) hydrocarbyl fatty acid ester(s), and combinations thereof. Even more preferred one or more ashless sulphur containing anti-oxidant(s) are one or more sulfurized aliphatic ($C_7$ to $C_{29}$) hydrocarbyl fatty acid ester(s).

Preferred ash containing sulphur containing anti-oxidant(s) include sulphur containing molybdenum compounds, especially sulphur containing organo-molybdenum compounds.

Highly preferred one or more sulphur containing anti-oxidant(s) is one or more sulfurized aliphatic ($C_7$ to $C_{29}$) hydrocarbyl fatty acid ester(s), sulphur containing organo-molybdenum compound(s), and combinations thereof. Most preferred sulphur containing anti-oxidant(s) is one or more sulfurized aliphatic ($C_7$ to $C_{29}$) hydrocarbyl fatty acid ester(s).

Sulfurized Olefin(s)

The one or more sulfurized olefin(s) may be obtained by sulfurizing the corresponding one or more olefin containing compound(s), for example as disclosed in US 2006/0205614 A. Suitable sulphur sources which may be used in the sulfurization reaction include: elemental sulphur; sulphur monochloride; sulphur dichloride; sodium sulphide; sodium polysulfide; and combinations thereof.

Suitable sulfurized olefins are commercially available, particularly those which are nitrogen free. The olefin compounds which may be sulfurized are diverse and contain at least one carbon to carbon non-aromatic double bond. Suitable olefin compound(s) which may be sulfurized include compound(s) of the formula $R^1R^2C{=}CR^3R^4$, wherein $R^1$, $R^2$, $R^3$ and $R^4$ each independently represent hydrogen, $C_1$ to $C_{25}$ alkyl, $CO_2R^5$, $CO_2M$, $C(R^6)$, $YR^7$, X, wherein $R^5$, $R^6$ and $R^7$ each independently represent hydrogen, $C_1$ to $C_{12}$ alkyl, $C_1$ to $C_{12}$ alkenyl, M is a metal cation (e.g. sodium, potassium or calcium). X is halogen and Y is oxygen or sulphur.

Preferred olefin compound(s) which may be sulfurized include $C_4$ to $C_{25}$ alkene(s) and carboxylate derivatives thereof, such as butyl cyclohex-1-ene carboxylate and dodecene.

Suitable sulfurized olefins may be obtained from Arkema (TPS20, TPS32 and TPS44).

Sulfurized Phenol(s)

Preferred one or more sulphur containing phenol(s) are derived by sulfurizing one or more hindered phenol(s). Suitable hindered phenols include 2-alkyl substituted phenol(s), 2,6-dialkyl substituted phenol(s), and combinations thereof, wherein at least one of the alkyl substituents comprises at least 3, preferably at least 4, carbon atoms. Such hindered phenol(s) include 2,6-di-tertbutyl phenol, 2-tert-butyl-6-methyl phenol, 2-tert-butyl-5-methyl phenol, and mixtures thereof. The most preferred one or more sulfurized phenol(s) is derived by sulfurizing one or more 2,6-di-alkyl phenol(s), especially 2,6-di-tertbutyl phenol(s). Accordingly, the one or more sulfurized phenol(s) include 4,4'-thiobis(2,6-di-t-butylphenol), 4,4'-dithiobis(2,6-di-t-butylphenol), 4,4'-thiobis(2-t-butyl-6-methylphenol), 4,4'-dithiobis(2-t-butyl-6-methylphenol), 4,4'-thiobis(2-t-butyl-5-methylphenol), and mixtures thereof; especially 4,4'-thiobis (2,6-di-t-butylphenol) and 4,4'-dithiobis(2,6-di-t-butylphenol) and mixtures of these. The sulfurized phenol(s) may be prepared by techniques well known to those in the art, for example as described in U.S. Pat. Nos. 3,250,712 and 4,946,610.

Sulfurized Fatty Acid Ester(s)

The one or more sulfurized fatty acid ester(s) is one or more sulfurized aliphatic ($C_7$ to $C_{29}$) hydrocarbyl fatty acid ester(s) which may typically be derived from sulfurizing the corresponding one or more aliphatic ($C_7$ to $C_{29}$) hydrocarbyl fatty acid ester(s). Suitably, to permit sulfurization of the aliphatic ($C_7$ to $C_{29}$) hydrocarbyl fatty acid ester(s) a proportion of the aliphatic ($C_7$ to $C_{29}$) hydrocarbyl chain(s) of the fatty acid ester(s) is unsaturated and includes at least one carbon to carbon double bond.

The fatty acid ester(s) may be derived from any suitable fatty acid(s). Typically, the fatty acid(s) is obtained from a natural source, for example, fatty acid(s) may be obtained from hydrolysis of fatty acid triglycerides which are obtainable from animal or vegetable oils. The fatty acid(s) may then be esterified to form the corresponding fatty acid ester(s) which is subsequently sulfurized by reaction with sulphur. Alternatively, or additionally, fatty acid triglyceride(s) may be sulfurized directly to form the corresponding sulfurized fatty acid triglyceride(s) or fatty acid triglyceride(s) may be trans-esterified to form different fatty acid ester(s) which is subsequently sulfurized by reaction with sulphur. Accordingly, the one or more sulfurized fatty acid ester(s) is typically derived from fatty acid(s) obtainable from animal or vegetable oils, especially vegetable oils.

Suitable aliphatic hydrocarbyl fatty acid(s) from which the one or more aliphatic ($C_7$ to $C_{29}$)hydrocarbyl fatty acid ester(s) may be derived and/or obtained in the natural esterified form (i.e. the glycerol ester) include one or more aliphatic ($C_7$ to $C_{29}$), preferably ($C_9$ to $C_{27}$), more preferably ($C_{11}$ to $C_{23}$), hydrocarbyl fatty acid(s) (i.e. aliphatic ($C_7$ to $C_{29}$)hydrocarbyl monocarboxylic acid(s)), wherein $C_x$ to $C_y$ designates the total number of carbon atoms in the aliphatic hydrocarbyl chain of the fatty acid, the fatty acid itself due to the presence of the carboxyl carbon atom includes a total of $C_{x+1}$ to $C_{y+1}$ carbon atoms. Preferably, the total number of carbon atoms in the one or more aliphatic hydrocarbyl fatty acid(s), inclusive of the carboxyl carbon atom, is an even number. Suitably, the aliphatic hydrocarbyl chain of the one or more aliphatic ($C_7$ to $C_{29}$) hydrocarbyl fatty acid(s) may be saturated or unsaturated (i.e. including at least one carbon to carbon double bond); preferably, the aliphatic hydrocarbyl chain of the one or more aliphatic ($C_7$ to $C_{29}$) hydrocarbyl fatty acid(s) is unsaturated and includes at least one carbon to carbon double bond. Preferred one or more aliphatic ($C_7$ to $C_{29}$) hydrocarbyl fatty acid(s) include one or more of myristoleic acid, palmitoleic acid, sapienic acid, hexadecatrienoic acid, oleic acid, stearidonic acid, elaidic acid, vaccenic acid, linoleic acid, linoelaidic acid, linolenic acid, arachidonic acid, eicosapentaenoic acid, eicosenoic acid, erucic acid, docosahexaenoic acid, docosahexaenoic acid, tetracosapentaenoic acid and tetracosatetraenoic acid. More preferred one or more aliphatic ($C_7$ to $C_{29}$) hydrocarbyl fatty acid(s) include one or more of oleic acid, linoleic acid and linolenic acid. Oleic acid is especially preferred.

The one or more aliphatic ($C_7$ to $C_{29}$) hydrocarbyl fatty acid(s), as defined therein, or a reactive derivative(s) thereof, may be esterified by reaction with one or more alkanol(s), as defined herein, to form the corresponding one or more aliphatic ($C_7$ to $C_{29}$) hydrocarbyl fatty acid ester(s). Suitable one or more alkanol(s) include monohydric ($C_1$ to $C_{20}$) alkanol(s), polyhydric ($C_2$ to $C_{20}$) alkanol(s) (e.g. glycerol, neopentyl glycol, trimethylolethane, trimethylolpropane, trimethylolbutante, pentaerythritol, dipentaerythritol, tripentaerythritol and sorbitol; glycerol being especially preferred), and combinations thereof. Preferably, the one or more alkanol(s) is a monohydric ($C_1$ to $C_{20}$) alkanol(s), preferably monohydric ($C_1$ to $C_6$) alkanol(s), even more preferably methanol.

Accordingly, suitable fatty acid ester(s) include one or more of aliphatic ($C_7$ to $C_{29}$), preferably ($C_9$ to $C_{27}$), more preferably ($C_{11}$ to $C_{23}$), hydrocarbyl fatty acid ester(s) which may be derived from the corresponding one or more aliphatic ($C_7$ to $C_{29}$) hydrocarbyl fatty acid(s), as defined herein, by reaction with one or more alkanol(s), as defined herein, or which may be obtained in a natural esterified form i.e. one or more aliphatic ($C_7$ to $C_{29}$) hydrocarbyl fatty acid glycerol ester(s).

Preferred fatty acid ester(s) include one or more of aliphatic ($C_7$ to $C_{29}$), preferably ($C_9$ to $C_{27}$), more preferably ($C_{11}$ to $C_{23}$), hydrocarbyl fatty acid $C_1$ to $C_{30}$ alkyl ester(s); more preferred fatty acid ester(s) include one or more of aliphatic ($C_7$ to $C_{29}$), preferably ($C_9$ to $C_{27}$), more preferably ($C_{11}$ to $C_{23}$), hydrocarbyl fatty acid $C_1$ to $C_6$ alkyl ester(s); even more preferred fatty acid ester(s) include one or more of aliphatic ($C_7$ to $C_{29}$), preferably ($C_9$ to $C_{27}$), more preferably to ($C_{11}$ to $C_{23}$), hydrocarbyl fatty acid methyl ester(s).

Additionally, or alternatively, the fatty acid ester may be in the form of a fatty acid glycerol ester. Suitably, fatty acid glycerol ester(s) include one or more of aliphatic ($C_7$ to $C_{29}$), preferably ($C_9$ to $C_{27}$), more preferably ($C_{11}$ to $C_{23}$), hydrocarbyl fatty acid $C_1$ to $C_{30}$ alkyl ester(s); more preferred fatty acid glycerol ester(s).

Accordingly, a proportion of the aliphatic hydrocarbyl chain(s) of the one or more aliphatic hydrocarbyl fatty acid ester(s) include at least one carbon to carbon double bond to permit sulfurization thereof and formation of the corresponding sulfurized fatty acid ester(s). Suitably, greater than or equal to about 40 mass %, preferably greater than or equal to about 50 mass %, and more preferably greater than or equal to about 55 mass % of the one or more aliphatic hydrocarbyl fatty acid ester(s) include an aliphatic hydrocarbyl chain having at least one carbon to carbon double bond. Suitably, less than or equal to about 95 mass %, preferably less than or equal to about 90 mass %, more preferably less than or equal to about 85 mass % of the one or more aliphatic hydrocarbyl fatty acid ester(s) include an aliphatic hydrocarbyl chain having at least one carbon to carbon double bond. Alternatively, essentially all of the one or more aliphatic hydrocarbyl fatty acid ester(s) include an aliphatic hydrocarbyl chain(s) having at least one carbon to carbon double bond (i.e. all of the fatty acid ester(s) are derived from unsaturated fatty acid(s)).

Suitably, the fatty acid ester(s) may be obtained directly from natural sources e.g. vegetable and/or animal oils. Such fatty acid(s) may already be in the form of a fatty acid glycerol ester. The fatty acid glycerol ester may be sulfurized directly to form the corresponding sulfurized fatty acid glycerol ester. Additionally, or alternatively, such fatty acid glycerol ester(s) may be trans-esterified to form fatty acid hydrocarbyl ester(s) (e.g. fatty acid methyl ester(s)), as defined herein, prior to being sulfurized to form the corresponding sulfurized fatty acid ester.

The sulfurized fatty acid ester(s) may be derived from any suitable fatty acid ester(s), but is preferably derived from a vegetable oil (e.g. glycerol ester(s) or trans-esterification product(s)), such as, but not limited to, one or more of palm oil, corn oil, grapeseed oil, coconut oil, cottonseed oil, wheatgerm oil, soya oil, safflower oil, olive oil, peanut oil, rapeseed oil and sunflower oil, or an animal oil (e.g. glycerol ester(s) or trans-esterification product(s)) such as tallow oil or lard oil. The sulfurized fatty acid ester(s) is preferably derived from one or more of palm oil, rapeseed oil, soya oil, tallow oil, lard oil, or a trans esterified product thereof. More preferably, the sulfurized fatty acid esters) is derived from a vegetable oil, especially one or more of palm oil, soya oil, rapeseed oil, or a trans-esterified product thereof. The sulfurized fatty acid ester(s) suitably comprise substantially only sulfurized fatty acid ester(s) and no other sulfurized carboxylic acid ester(s).

Accordingly, the one or more sulfurized fatty acid ester(s) include one or more sulphurized aliphatic ($C_7$ to $C_{29}$), preferably ($C_9$ to $C_{27}$), more preferably ($C_{11}$ to $C_{23}$), hydrocarbyl fatty acid $C_1$ to $C_{30}$ alkyl ester(s), especially $C_1$ to $C_6$ alkyl ester(s) e.g. methyl ester(s), and/or one or more sulphurized aliphatic ($C_7$ to $C_{29}$), preferably ($C_9$ to $C_{27}$), more preferably ($C_{11}$ to $C_{23}$), hydrocarbyl fatty acid $C_1$ to $C_{30}$ glycerol ester(s). The sulphurized aliphatic ($C_7$ to $C_{29}$), preferably ($C_9$ to $C_{27}$), more preferably ($C_{11}$ to $C_{23}$), hydrocarbyl fatty acid $C_1$ to $C_{30}$ alkyl ester(s), especially $C_1$ to $C_6$ alkyl ester(s) e.g. methyl ester(s), being especially preferred.

Suitable methods to make the sulfurized fatty acid ester(s) are well known. A suitable method, by way of example, is described in Lubricant Additives: Chemistry and Applications, Ed. Leslie R Rudnick, Chapter 9 (Sulphur Carriers-T. Rossrucker and A Fessenbecker), CPC Press 2003. This method generally comprises mixing the unsaturated fatty acid ester(s) starting material with elemental sulfur and heating to about the melting point of the sulphur at low or moderate pressure (1-2 bar). The reaction may take place in the presence or absence of a catalyst. The resulting sulfurized fatty acid ester(s) may be post-treated by subjecting the ester to sparging with a nitrogen and/or nitrogen and oxygen gas mixture at elevated temperature.

As the sulfurized fatty acid ester(s) is preferably derived from natural oils, it typically comprises a mixture of different molecular structures, including some unreacted (or non-sulfurized) fatty acid ester(s). The sulfurized fatty acid ester typically comprises of molecules having sulphur bridging groups. Suitably, the sulfurized fatty acid ester(s) comprise fatty acid ester molecules bonded together by sulphur bridging groups comprising predominantly from 1 to 8 sulphur atoms. Alternatively, or additionally, the sulfurized fatty acid ester(s) may comprise molecules having one or more of the sulphur group(s) selected from thioether groups, thiacyclopropane groups, thiol, dithiirane, thiophene groups or thiocarbonyl groups.

The preferred sulfurized fatty acid ester(s) for use in the present invention are believed to comprise predominately sulfurized ester molecule(s) having a structure according to Formula 1 shown below. The sulfurized fatty acid ester(s) may comprise a minor proportion of compounds having a structure defined by any of Formulas 2 to 7 below. Preferably the compounds having a structure of Formula 2 to 7 are only present in impurity quantities.

Formula 1

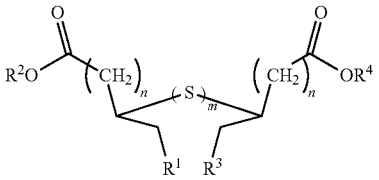

Formula 2

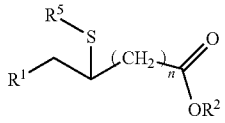

Formula 3

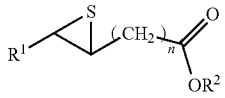

-continued

Formula 4

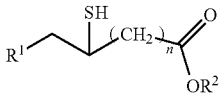

Formula 5

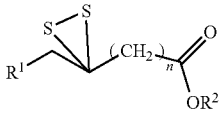

Formula 6

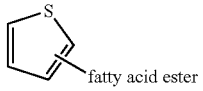

Formula 7

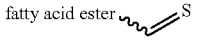

Whilst the sulfurized fatty acid ester of Formula 1 may comprise m=1 to 8, preferably the molecules in the sulfurized fatty acid ester in the highest proportion comprise a structure where m=3 to 5.

Suitably, in Formulae 1 to 7 above: $R^1$ and $R^3$ each independently represent a hydrocarbyl group, preferably an alkyl group, such that the total backbone chain, with intervening methylene groups and sulfur-bound carbon atoms to the carbonyl group, is 12 to 24 carbon atoms in length; $R^2$ and $R^4$ each independently represent H or hydrocarbyl, preferably H or $C_1$ to $C_6$ alkyl, especially H or methyl; $R^5$ represents H or hydrocarbyl; and, n=0 to 18, preferably n=0 to 12, more preferably n=0 to 10 or n=0 to 8. Advantageously, the majority of the ester comprises a molecule where n=7. Suitable sulfurized fatty acid esters are available commercially and examples of suitable compounds include Dover Chemical's Base 10SE, Additin RC2310 or Additin RC2410 all from Rhein Chemie, and Esterol 10S from Arkema.

The amount of sulphur provided to the lubricating oil composition by the one or more sulfurized fatty acid ester(s) will depend upon the sulphur content of the sulfurized fatty acid ester(s) and the amount of sulfurized fatty acid ester(s) added to the lubricating oil composition.

Suitably, the one or more sulfurized fatty acid ester(s) provides the lubricating oil composition with greater than or equal to about 0.01, preferably greater than or equal to about 0.02, even more preferably greater than or equal to 0.03, even more preferably greater than or equal to 0.04, mass % sulphur, based on the total mass of the lubricating oil composition. Suitably, the one or more sulfurized fatty acid ester(s) provides the lubricating oil composition with less than or equal to about 0.30, preferably less than or equal to 0.25, more preferably less than or equal to 0.20, mass % sulphur, based on the total mass of the lubricating oil composition. Suitably, the one or more sulfurized fatty acid ester(s) provides the lubricating oil composition with from 0.02 mass to 0.30 mass % sulphur, preferably from 0.02 mass % to 0.20 mass % sulphur, more preferably 0.02 to 0.10 mass % sulphur.

Suitably, the sulphur content of the sulfurized fatty acid ester(s) is greater than or equal to about 5, more preferably greater than or equal to about 7, even more preferably greater than or equal to about 9, even more preferably greater than or equal to about 10, mass % sulphur, based on the mass of the sulfurized fatty acid ester(s). Suitably, the sulphur content of the sulfurized fatty acid ester(s) is less than or equal to about 40, preferably less than or equal to 30, more preferably less than or equal to 25, preferably less than or equal to 20, mass % sulphur, based on the mass of the sulfurized fatty acid ester(s). Any suitable method may be used to determine the sulphur content of the sulfurized fatty acid ester, for example, one suitable method uses a CHNS-932 elemental analyser available from LECO Corporation, USA.

Suitably, the sulfurized fatty acid ester(s) is phosphorous free. Suitably, the sulfurized fatty acid ester(s) is ashless.

Molybdenum Compounds

Any suitable oil-soluble or oil-dispersible sulphur containing molybdenum compound(s) having anti-oxidancy properties may be employed in the lubricating oil composition, typically such compound(s) also exhibit friction modifying properties. Preferably, the oil-soluble or oil-dispersible molybdenum compound(s) is an oil-soluble or oil-dispersible sulphur containing organo-molybdenum compound.

Examples of such sulphur containing organo-molybdenum compound(s) include molybdenum dithiocarbamates, molybdenum dithiophosphates, molybdenum dithiophosphinates, molybdenum xanthates, molybdenum thioxanthates, molybdenum sulfides, and the like, and mixtures thereof. Particularly preferred are molybdenum dithiocarbamates, molybdenum dialkyldithiophosphates, molybdenum alkyl xanthates and molybdenum alkylthioxanthates. An especially preferred sulphur containing organo-molybdenum compound(s) is molybdenum dithiocarbamate(s), particularly molybdenum dialkyldithiocarbamates.

The sulphur containing molybdenum compound(s) may be mono-, di-, tri- or tetra-nuclear. Di-nuclear and tri-nuclear molybdenum compound(s) are preferred, especially preferred are tri-nuclear molybdenum compound(s). Suitably, preferred sulphur containing organo-molybdenum compound(s) includes di- or tri-nuclear organo-molybdenum compound, more preferably di- or tri-nuclear molybdenum dithiocarbamate(s) (e.g. dialkyldithiocarbamates), especially tri-nuclear molybdenum dithiocarbamate(s), such as tri-nuclear molybdenum dialkyldithiocarbamate(s).

Oil-soluble or oil-dispersible tri-nuclear molybdenum compounds can be prepared by reacting in the appropriate liquid(s)/solvent(s) a molybdenum source such as $(NH_4)_2Mo_3S_{13}\cdot n(H_2O)$, where n varies between 0 and 2 and includes non-stoichiometric values, with a suitable ligand source such as a tetralkylthiuram disulfide. Other oil-soluble or dispersible tri-nuclear molybdenum compounds can be formed during a reaction in the appropriate solvent(s) of a molybdenum source such as of $(NH_4)_2Mo_3S_{13}\cdot n(H_2O)$, a ligand source such as tetralkylthiuram disulfide, dialkyldithiocarbamate, or dialkyldithiophosphate, and a sulfur abstracting agent such as cyanide ions, sulfite ions, or substituted phosphines. Alternatively, a tri-nuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

Suitably, the sulphur containing molybdenum compound(s), if present, is present in an amount that provides the lubricating oil composition with at least 5, such as at least 20, or at least 40, preferably at least 60 ppm of molybdenum (ASTM D5185), based on the total mass of the lubricating oil composition. If present, the sulphur containing molybdenum compound(s) provides the lubricating oil composition with less than or equal to 1200, such as less than or equal to 1000, or less than or equal to 750 or less than or equal to 500, or less than or equal to 200 ppm of molybdenum (ASTM D5185), based on the total mass of the lubricating oil composition.

Whilst the invention does not require any sulphur containing molybdenum compound to be present, some molybdenum may be beneficial for wear performance. The sulphur containing molybdenum compound may be present in an amount to provide 2 to 1200, suitably from 5 to 1000, or from 5 to 750, preferably from 5 to 500, more preferably 5 to 200, ppm of molybdenum based on the total mass of the lubricating oil composition.

Alkene(s) (C)

The lubricating oil composition of the present invention requires the presence of one or more oil-soluble or oil-dispersible alkene(s) having greater than or equal to 10 carbon atoms (preferably 12 or more carbon atoms). Such alkene(s) are obtainable from fine chemical suppliers such as Sigma Aldrich.

Preferably, the one or more oil-soluble or oil-dispersible alkene(s) having 10 or more carbon atoms is one or more $C_{10}$ to $C_{22}$ alkene(s), more preferably one or more $C_{10}$ to $C_{20}$ alkene(s), even more preferably one or more $C_{10}$ to $C_{18}$ alkene(s), even more preferably one or more $C_{12}$ to $C_{18}$ alkene(s), especially one or more $C_{14}$ to $C_{18}$ alkene(s). In a preferred embodiment of the present invention, the lubricating oil composition includes one or more $C_{14}$ alkene(s).

The one or more oil-soluble or oil-dispersible alkene(s) having 10 or more carbon atoms may each independently have an even or odd number of carbon atoms. Preferably, a major amount (i.e. greater than 50 mole %) of the one or more oil-soluble or oil-dispersible alkene(s) having 10 or more carbon atoms has an even number of carbon atoms. Accordingly, preferred one or more alkene(s) having 10 or more carbon atoms comprise one or more $C_{10}$, $C_{12}$, $C_{14}$, $C_{16}$, $C_{18}$, $C_{20}$, $C_{22}$ alkene(s), more preferably one or more $C_{10}$, $C_{12}$, $C_{14}$, $C_{16}$, $C_{18}$, $C_{20}$, alkene(s), even more preferably one or more $C_{10}$, $C_{12}$, $C_{14}$, $C_{16}$, $C_{18}$ alkene(s), even more preferably one or more $C_{12}$, $C_{14}$, $C_{16}$, $C_{18}$ alkene(s), most preferably one or more $C_{14}$, $C_{16}$, $C_{18}$ alkene(s), especially one or more $C_{14}$ alkene(s).

The one or more oil-soluble or oil-dispersible alkene(s) having 10 or more carbon atoms may each independently have one or more carbon to carbon double bond(s). Preferably, a major amount (i.e. greater than 50 mole %) of the one or more alkene(s) having 10 or more carbon atoms have a single carbon to carbon double bond. Suitably, greater than 60, more preferably greater than 70, even more preferably greater than 75, even more preferably greater than 80, even more preferably greater than 85, even more preferably greater than 90, mole % of the one or more alkene(s) having 10 or more carbon atoms, as defined herein, have a single carbon to carbon double bond.

The one or more oil-soluble or oil-dispersible alkene(s) having 10 or more carbon atoms may each independently have one or more carbon to carbon terminal double bond(s), one or more carbon to carbon internal double bond(s), or a combination thereof. Preferably, a major amount (i.e. greater than 50 mole %) of the one or more alkene(s) having 10 or more carbon atoms have one or more carbon to carbon terminal double bond(s) only (i.e. no internal carbon to carbon double bonds), especially a single carbon to carbon terminal double bond only. Suitably, greater than 60, preferably greater than 70, even more preferably greater than 75, even more preferably greater than 80, even more preferably greater than 85, even more preferably greater than 90, mole % of the one or more alkene(s) having 10 or more carbon atoms have one or more carbon to carbon terminal double bond(s) only, especially only a single carbon to carbon terminal double bond. Suitably, the one or more alkene(s) having 10 or more carbon atoms, as defined herein, comprise one or more to $C_{10}$ to $C_{22}$ alk-1-ene(s) (i.e. α-olefins are preferred).

Accordingly, preferred one or more oil-soluble or oil-dispersible alkene(s) having 10 or more carbon atoms comprise one or more $C_{10}$ to $C_{22}$ alk-1-ene(s), even more preferably one or more $C_{10}$ to $C_{20}$ alk-1-ene(s), even more preferably one or more $C_{10}$ to $C_{18}$ alk-1-ene(s), even more preferably one or more $C_{12}$ to $C_{18}$ alk-1-ene(s), even more preferably one or more $C_{14}$ to $C_{18}$ alk-1-ene(s), especially such alk-1-ene(s) having an even number of carbon atoms as defined herein.

The one or more oil-soluble or oil-dispersible alkene(s) having 10 or more carbon atoms may, when there is a sufficient number of carbon atoms, be linear or branched, be cyclic, acyclic or part cyclic/acyclic. Preferably, a major amount (i.e. greater than 50 mole %) of the one or more alkene(s) having 10 or more carbon atoms comprise one or more acyclic $C_{10}$ to $C_{22}$ alkene(s), more preferably one or more linear acyclic $C_{10}$ to $C_{20}$, even more preferably one or more linear acyclic $C_{10}$ to $C_{18}$, even more preferably one or more linear acyclic $C_{12}$ to $C_{18}$, even more preferably one or more linear acyclic $C_{14}$ to $C_{18}$, alkene(s), as defined herein. Suitably, greater than 50, preferably greater than 60, more preferably greater than 70, even more preferably greater than 75, even more preferably greater than 80, even more preferably greater than 85, even more preferably greater than 90, mole % of the one or more alkene(s) having 10 or more carbon atoms, as defined herein, is an acyclic, more preferably an acyclic linear, $C_{10}$ to $C_{22}$ alkene(s) (preferably $C_{12}$ to $C_{18}$ alkene(s)), as defined herein.

Accordingly, highly preferred one or more alkene(s) having 10 or more carbon atoms comprise one or more $C_{12}$ to $C_{18}$ alkene(s), more preferably one or more linear acyclic $C_{12}$ to $C_{18}$ alkene(s), even more preferably one or more linear acyclic $C_{12}$ to $C_{18}$ alk-1-ene(s), even more preferably one or more linear acyclic $C_{12}$, $C_{14}$, $C_{16}$, $C_{18}$ alk-1-ene(s) (i.e. dodec-1-ene, tetradec-1-ene, hexadec-1-ene, octadec-1-ene), even more preferably one or more linear acyclic $C_{14}$, $C_{16}$, $C_{18}$ alk-1-ene(s) (i.e. tetradec-1-ene, hexadec-1-ene, octadec-1-ene), in particular one or more linear acyclic $C_{14}$ alk-1-ene(s), especially tetradec-1-ene.

The one or more oil-soluble or oil-dispersible alkene(s) having 10 or more carbon atoms, as defined herein, is typically present in an amount of greater than or equal to 0.01, more preferably greater than or equal to 0.03, even more preferably greater than or equal to 0.05, even more preferably greater than or equal to 0.07, even more preferably greater than or equal to 0.10, even more preferably greater than or equal to 0.15, even more preferably greater than or equal to 0.20, mass % based on the total mass of the lubricating oil composition. Preferably, the one or more oil-soluble or oil-dispersible alkene(s) having 10 or more carbon atoms, as defined herein, is typically present in an amount of less than or equal to 5.0, more preferably less than or equal to 4.0, even more preferably less than or equal to 3.0, even more preferably less than or equal to 2.0, even more preferably less than or equal to 1.5, mass % based on the total mass of the lubricating oil composition. Accordingly, the one or more oil-soluble or oil-dispersible alkene(s) having 10 or more carbon atoms is typically present in an amount of from 0.05 to 3.0, preferably 0.1 to 2.0, more preferably 0.2 to 1.5, mass % based on the total mass of the lubricating oil composition.

Ashless Anti-Oxidant (D)

The lubricating oil composition may optionally include an effective minor amount of one or more oil-soluble or oil dispersible ashless non-sulphur containing anti-oxidant(s) (D).

Suitably, the one or more oil-soluble or oil-dispersible ashless non-sulphur containing anti-oxidant(s) comprises an oil-soluble or oil-dispersible aminic anti-oxidant, such as an aromatic amine anti-oxidant (e.g. dialkyl substituted diphenylamine(s)), a phenolic anti-oxidant, such as a hindered phenolic anti-oxidant (e.g. dialkyl substituted phenol anti-oxidant), or a combination thereof. Ashless aminic anti-oxidant(s), especially aromatic amine anti-oxidant(s) such as dialkyl substituted diphenylamine(s), are particularly preferred. Most preferred anti-oxidant(s) are the dialkyl substituted diphenylamines, such as di-$C_4$-$C_{20}$ alkyl substituted diphenylamines and/or the hindered phenols, such as iso-octyl-3,5-di-tert-butyl-4-hydroxycinnamate.

Suitably, the one or more ashless non-sulphur containing anti-oxidant(s) may be present in an amount of from 0.1 to 10, preferably 0.25 to 7.5, more preferably 0.5 to 5, mass %, based on the total mass of the lubricating oil composition.

Although the inclusion of one or more oil-soluble or oil-dispersible ashless non-sulphur containing anti-oxidant(s) (D) in the lubricating oil composition may be preferred, it is not essential.

Dihydrocarbyl Dithiophosphate Metal Salt (E)

The lubricating oil composition may optionally include an effective minor amount of one or more oil-soluble or oil-dispersible dihydrocarbyl dithiophosphate metal salt(s) (E), especially one or more dihydrocarbyl dithiophosphate zinc salt(s) (ZDDP(s)).

Dihydrocarbyl dithiophosphate metal salt(s) wherein the metal may be an alkali or alkaline earth metal, or aluminium, lead, tin, molybdenum, nickel copper, or preferably, zinc, represent anti-wear component(s) that reduce friction and excessive wear. Dihydrocarbyl dithiothosphate metal salt(s) may be prepared in accordance with known techniques by first forming a dihydrocarbyl dithiophosphoric acid (DDPA) usually by reaction of one or more alcohols or phenol with $P_2S_5$ and the neutralizing the formed DDPA with a metal compound.

The preferred one or more zinc dihydrocarbyl dithiophosphate(s) (ZDDP(s)) are oil-soluble salts of dihydrocarbyl dithiophosphoric acids and may be represented by the following formula:

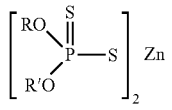

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The one or more zinc dihydrocarbyl dithiophosphate(s) can therefore comprise one or more zinc dialkyl dithiophosphate(s).

Suitably, if present, the one or more dihydrocarbyl dithiophosphate metal salt(s) (E), especially one or more dihydrocarbyl dithiophosphate zinc salt(s) (ZDDP(s)), as defined herein, is added to the lubricating oil composition in amounts sufficient to provide no greater than 1200 ppm, preferably no greater than 1000 ppm, more preferably no greater than 900 ppm, most preferably no greater than 850 ppm by mass of phosphorous to the lubricating oil composition, based upon the total mass of the lubricating oil composition, and as measured in accordance with ASTM D5185. The ZDDP is suitably added to the lubricating oil composition in amounts sufficient to provide at least 100 ppm, preferably at least 350 ppm, more preferably at least 500 ppm by mass of phosphorous to the lubricating oil, based upon the total mass of the lubricating oil composition, and as measured in accordance with ASTM D5185.

Although the inclusion of additive (E) in the lubricating composition is preferred, it is not essential.

Ashless Dispersant (F)

The lubricating oil composition may optionally include an effective minor amount of one or more oil-soluble or oil-dispersible ashless dispersants.

Ashless dispersants are non-metallic organic materials that form substantially no ash on combustion, in contrast to metal-containing, and hence ash-forming, materials. They comprise a long chain hydrocarbon with a polar head, the polarity being derived from inclusion of, e.g. an O, P or N atom. The hydrocarbon is an oleophilic group that confers oil-solubility, having, for example 40 to 500 carbon atoms. Thus, ashless dispersants may comprise an oil-soluble polymeric hydrocarbon backbone having functional groups that are capable of associating with particles to be dispersed. Typically, dispersants comprise amine, alcohol, amide, or ester polar moieties attached to the polymer backbone often via a bridging group. Ashless dispersants may be, for example, selected from oil-soluble salts, esters, amino-esters, amides, imides, and oxazolines of long chain hydrocarbon-substituted mono- and dicarboxylic acids or their anhydrides; thiocarboxylate derivatives of a long chain of hydrocarbons; long chain aliphatic hydrocarbons having a polyamine attached directly thereto, and Mannich condensation products formed by condensing a long chain substituted phenol with formaldehyde and alkylene polyamine, such as described in U.S. Pat. No. 3,442,808.

The oil-soluble polymeric hydrocarbon backbone is typically an olefin polymer or polyene, especially a polymer comprising a major molar amount (i.e. greater than 50 mole %) of a $C_2$ to $C_{18}$ olefin (e.g. ethylene, propylene, butylenes, isobutylene, pentene, octane-1, styrene), and typically a $C_2$ to $C_5$ olefin. The oil-soluble polymeric hydrocarbon backbone may be homopolymeric or a copolymer of two different alpha-olefins.

A preferred class of olefin polymers comprises polybutenes, specifically polyisobutenes (PIB) or poly-n-butenes, such as may be prepared by polymerization of a $C_4$ refinery stream. Other classes of olefin polymers include ethylene alpha-olefin (EAO) copolymers and alpha-olefin homo- and copolymers.

Ashless dispersants include, for example, derivatives of long chain hydrocarbon-substituted carboxylic acids, examples being derivatives of high molecular weight hydrocarbyl-substituted succinic acid. A noteworthy group of dispersants are hydrocarbon-substituted succinimides, made, for example, by reacting the high molecular weight hydrocarbyl-substituted succinic acid(s) (or derivatives thereof) with a nitrogen-containing compound, advantageously a polyalkylene polyamine, such as polyethylene polyamine. Particularly preferred are the reaction products of polyalkylene polyamines with polyalkene succinic anhydrides, especially polyisobutenyl succinic anhydrides, such as described in U.S. Pat. Nos. 3,202,678; 3,154,560 3,172,892; 3,024,195, 3,024,237; 3,219,666; and 3,216,936; and BE-A-66,875.

Preferred dispersants are polyalkene-substituted succinimides wherein the polyalkene group has a number-average molecular weight in the range of 900 to 5,000. The number-average molecular weight is measured by gel permeation chromatography (GPC). The polyalkene group may comprise a major molar amount (i.e. greater than 50 mole %) of a $C_2$ to $C_{18}$ alkene, e.g. ethene, propene, butene, isobutene, pentene, octane-1 and styrene. Preferably, the alkene is a $C_2$ to $C_5$ alkene; more preferably it is butene or isobutene, such as may be prepared by polymerisation of a $C_4$ refinery stream. Most preferably, the number average molecular weight of the polyalkene group is in the range of 950 to 2,800.

Highly preferred one or more ashless dispersants comprise one or more polyalkene succinimides, especially one or more polyisobutene succinimides (PIBSA-PAM). Suitably, the number average molecular weight of the polyalkene group (i.e. polyisobutene group of polyisobutene succinimide) is in the range of 950 to 2,800. Such dispersant(s) are typically formed by reaction of the corresponding polyalkylene succinic anhydride (e.g. PIBSA) with a polyamine (PAM). If one or more ashless(s) dispersants), is present, then preferably the one or more polyalkylene succinimide(s), especially one or more polyisobutylene succinimide(s), represent the only ashless containing dispersants in the lubricating oil composition.

Suitably, if present, the one or more ashless dispersant(s) is present in an amount of from 0.1 to 20, preferably 1 to 15, more preferably 2 to 10, mass %, based on the total mass of the lubricating oil composition. Suitably, if present, the one or more nitrogen containing ashless dispersant(s) provides the lubricating oil composition(s) with up to 0.20, preferably up to 0.15, more preferably up to 0.10, mass % nitrogen, based on the total mass of the composition and as measured according to ASTM method D5291. Suitably, if present, the one or more nitrogen containing ashless dispersant(s) provides the lubricating oil composition(s) with greater than or equal to 0.01, preferably greater than or equal to 0.02, more preferably greater than or equal to 0.03, mass % nitrogen, based on the total mass of the composition and as measured according to ASTM method D5291.

The above ashless dispersants may be post-treated with boron to form the corresponding borated dispersant, in ways known in the art, such as described in U.S. Pat. Nos. 3,087,936, 3,254,025 and 5,430,105. Boration may for example be accomplished by treating an acyl nitrogen-containing dispersant with a boron compound selected from boron oxide, boron halides, boron acids and esters of boron acids, in an amount sufficient to provide from about 0.1 to about 20 atomic proportions of boron for each mole of ashless dispersant If a borated dispersant is present in the lubricating oil composition, the amount of boron provided to the lubricating oil composition by the borated dispersant is suitably at least 10, such as at least 30, for example, at least 50 or even at least 65 ppm of boron, based on the total mass of the lubricating oil composition. If present, the borated dispersant suitably provides no more than 1000, preferably no more than 750, more preferably no more than 500 ppm of boron to the lubricating oil composition, based on the total mass of the lubricating oil composition.

Although the inclusion of additive (E) in the lubricating composition is preferred, it is not essential.

Engines

The lubricating oil compositions of the invention may be used to lubricate mechanical engine components, particularly in internal combustion engines, e.g. spark-ignited or compression-ignited internal combustion engines, particularly spark-ignited or compression-ignited two- or four-stroke reciprocating engines, by adding the composition thereto. The engines may be conventional gasoline or diesel engines designed to be powered by gasoline or petroleum diesel, respectively; alternatively, the engines may be specifically modified to be powered by an alcohol based fuel or biodiesel fuel.

Co-Additives

Other co-additives, in addition to additives (B) and (C), and the optional additives (D), (E) and (F) if present, which may be included in the lubricating oil composition comprise one or more oil-soluble or oil-dispersible co-additives selected from metal-containing detergents, corrosion inhibitors, pour point depressants, anti-wear agents, friction modifiers, anti-foam agents, viscosity modifiers and demulsifiers. Suitably, such co-additive(s) (i.e. the total amount of all such co-additives) are present in an amount of 0.1 to 30 mass % on an active ingredient basis, based on the total mass of the lubricating oil composition.

Co-additives, with representative effective amounts, that may also be present, different from additive components (B) and (C), but including the optional additives (D), (E) and (F) if present, are listed below. All the values listed are stated as mass percent active ingredient in a fully formulated lubricant.

| Additive | Mass % (Broad) | Mass % (Preferred) |
|---|---|---|
| Ashless Dispersant | 0.1-20 | 1-8 |
| Metal Detergents | 0.1-15 | 0.2-9 |
| Friction modifier | 0-5 | 0-1.5 |
| Corrosion Inhibitor | 0-5 | 0-1.5 |
| Metal Dihydrocarbyl Dithiophosphate | 0-10 | 0-4 |
| Anti-Oxidants | 0-5 | 0.01-3 |
| Pour Point Depressant | 0.01-5 | 0.01-1.5 |
| Anti-Foaming Agent | 0-5 | 0.001-0.15 |
| Supplement Anti-Wear Agents | 0-5 | 0-2 |
| Viscosity Modifier (1) | 0-10 | 0.01-4 |
| Mineral or Synthetic Base Oil | Balance | Balance |

(1) Viscosity modifiers are used only in multi-grade oils.

The final lubricating oil composition, typically made by blending the or each additive into the base oil, may contain from 5 to 25, preferably 5 to 18, typically 7 to 15, mass % of the co-additives, the remainder being oil of lubricating viscosity.

The above-mentioned co-additives are discussed in further detail as follows; as is known in the art, some additives can provide a multiplicity of effects, for example, a single additive may act as a dispersant and as an oxidation inhibitor.

Anti-wear agents reduce friction and excessive wear and are usually based on compounds containing sulfur or phosphorous or both, for example that are capable of depositing polysulfide films on the surfaces involved. Noteworthy are dihydrocarbyl dithiophosphate metal salts (E), as described herein, wherein the metal may be an alkali or alkaline earth metal, or aluminium, lead, tin, molybdenum, manganese, nickel, copper, or preferably, zinc.

Examples of ashless anti-wear agents include 1,2,3-triazoles, benzotriazoles, sulfurised fatty acid esters, and dithiocarbamate derivatives.

Metal detergents which may be present include oil-soluble neutral and overbased salicylates, sulfonates, phenates, sulfurized phenates, thiophosphonates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Combinations of detergents, whether overbased or neutral or both, may be used.

Ashless Friction modifiers may be present in the lubricating oil compositions of the present invention and are known generally and include esters formed by reacting carboxylic acids and anhydrides with alkanols and amine-based friction modifiers. Other useful friction modifiers generally include a polar terminal group (e.g. carboxyl or hydroxyl) covalently bonded to an oleophilic hydrocarbon chain. Esters of carboxylic acids and anhydrides with alkanols are described in U.S. Pat. No. 4,702,850, Examples of other conventional organic friction modifiers are described by M. Belzer in the "Journal of Tribology" (1992), Vol, 114, pp. 675-682 and M. Belzer and S. Jahanmir in "Lubrication Science" (1988), Vol. 1, pp. 3-26.

Preferred organic ashless nitrogen-free friction modifiers are esters or ester-based; a particularly preferred organic ashless nitrogen-free friction modifier is glycerol monooleate (GMO).

Ashless aminic or amine-based friction modifiers may also be used and include oil-soluble alkoxylated mono- and di-amines, which improve boundary layer lubrication.

Typically, the total amount of additional organic ashless friction modifier in a lubricant according to the present invention does not exceed 5 mass %, based on the total mass of the lubricating oil composition and preferably does not exceed 2 mass % and more preferably does not exceed 0.5 mass %.

Viscosity modifiers (VM) function to impart high and low temperature operability to a lubricating oil. The VM used may have that sole function, or may be multifunctional. Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1, 3, 4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the lubricating composition, they are preferably present in an amount not exceeding 0.2 wt. % active ingredient.

A small amount of a demulsifying component may be used. A preferred demulsifying component is described in EP 330522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient or elevated temperatures.

Preferably, all the additives except for the viscosity modifier and the pour point depressant are blended into a concentrate or additive package described herein as the additive package that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final lubricating oil formulation may employ from 2 to 20, preferably 4 to 18, and most preferably 5 to 17, mass of the concentrate or additive package with the remainder being base stock.

EXAMPLES

The invention will now be described in the following examples which are not intended to limit the scope of the claims hereof.

Nitrile Elastomer Seal Compatibility Test (VDA 675 301)

Compatibility with nitrile elastomer seals is measured using the Mercedes Benz Seals Test in accordance with VDA 675 301. The performance was measured against the GF-5 requirements of: Elongation at Break (EAB) limit of −35% maximum; and, Tensile Strength (TS) change limit of −20% maximum. Higher value(s) of EAB and/or TS is indicative of improved nitrile elastomer seals performance.

High Temperature Corrosion Bench Test (ASTM D6594-06)

Corrosion control is measured using the High Temperature Corrosion Bench Test (HTCBT) in accordance with ASTM D6594-06. This test method simulates the corrosion of non-ferrous metals, such as copper and lead found in cam followers and bearings, in lubricants; the corrosion process under investigation being induced by lubricant chemistry rather than lubricant degradation or contamination.

The concentration of copper and lead in the lubricating oil composition after testing and a reference sample of the lubricating oil composition (i.e. a fresh sample of the lubricating oil composition before testing) is then determined in accordance with ASTM D5185. The difference between the concentration of each of the metal contaminants in the tested lubricating oil composition and those of the reference sample lubricating oil composition provides a value for the change in the various metal concentrations before and after the test. The industry standard limits to meet the requirements of API CJ-4 are 20 ppm maximum for copper and 120 ppm maximum for lead.

Sequence IIIG Engine Test (ASTM D7320-07)

Viscosity increase of a lubricating oil composition is measured using the Sequence IIIG Engine Test according to method ASTM D7320-07. The test is modified as the engine is run for the time taken for the viscosity of lubricating oil composition(s) (KV40) to increase by 50% as measured by ASTM D445. A longer time taken for KV40 to increase by 50% is indicative of improved oxidative stability of the lubricating oil composition.

Examples 1 to 10—Sulfurized Fatty Acid Ester

The lubricating oil compositions of Examples 1 to 10, as well as the Reference Lubricant 1 (Ref 1) and Comparative Lubricants A, B and C, as detailed in Table 1, were each subjected to the Nitrile Elastomer Seal Compatibility Test (VDA 675 301) and, where indicated, the High Temperature Corrosion bench Test (ASTM D6594-06). In addition to the additive components detailed in Table 1, each of the lubricating oil compositions of Examples 1 to 10, Comparative Lubricants A, B and C, and Reference Lubricant 1 include identical amounts of the following identical components: dispersant; ZDDP; overbased sulfonate detergent; organo molybdenum trimer (providing 50 ppm molybdenum); aromatic amine anti-oxidant; and, viscosity modifier.

In the Examples, sulfurized rapeseed methyl ester (SRME) was obtained by sulphurizing rapseed oil methyl ester (approximately 17% sulphur content), as described hereinbefore, dec-1-ene ($C_{10}$ α-olefin), dodec-1-ene ($C_{12}$ α-olefin), tetrapropylene ($C_{12}$ branched olefin), tetradec-1-ene ($C_{14}$ α-olefin), hexadec-1-ene ($C_{16}$ α-olefin), octadec-1-ene ($C_{18}$ α-olefin) are obtainable from Sigma Aldrich. Polyisobutylene (PIB) has a Mn of approximately 950 and is available from Infineum UK Ltd. The amount of each additive in each lubricating oil composition is expressed in terms of mass % on an active ingredient basis, based on the total mass of the lubricating oil composition.

Examples 2, 4 and 6, each include the same amount of the respective alkene on a molar mass active ingredient basis (i.e. the molar amount of each respective alkene in each of these examples is identical), and these examples are directly comparable. Similarly, Examples 7 to 10 and Comparative Example C each include the same amount of the respective alkene on a molar mass active ingredient basis (i.e. the molar amount of each respective alkene in each of these examples is identical), and these examples are directly comparable. In Comparative Example A and Examples 1 to 6, SRME provides 400 ppm of sulphur to the lubricating oil composition; whereas, in Comparative Examples B and C and Examples 7 to 10, SRME provides 800 ppm of sulphur to the lubricating oil composition.

and EAB results of Examples 7 to 10 with Comparative Example B); such improvement(s) is significantly greater than the use of a polyisobutylene ((PIB)—see Comparative Example C).

The HTCBT data demonstrate that the addition of an alkene having 10 or more carbon atoms, particularly an alkene having at least 14 carbon atoms, to a lubricant which includes a sulphur containing anti-oxidant (SRME) typically improves copper corrosion performance (compare Examples 1 and 2 with Comparative Lubricant A). Moreover, the addition of an alkene, particularly an alkene having at least 10 carbon atoms, to a lubricant which includes a sulphur containing anti-oxidant (SRME) typically improves lead corrosion performance (compare Examples 1 to 6 with Comparative Lubricant A).

TABLE 1

| | Ref 1 | A | 1 | 2 | 3 | 4 | 5 | 6 | B | 7 | 8 | 9 | 10 | C |
|---|---|---|---|---|---|---|---|---|---|---|---|---|---|---|
| SRME* | — | 0.23 | 0.23 | 0.23 | 0.23 | 0.23 | 0.23 | 0.23 | 0.47 | 0.47 | 0.47 | 0.47 | 0.47 | 0.47 |
| Dec-1-ene ($C_{10}$ α-olefin) | — | — | — | — | — | — | 0.25 | 0.5 | — | — | — | — | — | — |
| Dodec-1-ene ($C_{12}$ α-olefin) | — | — | — | — | — | — | — | — | — | 0.43 | — | — | — | — |
| Tetrapropylene ($C_{12}$ olefin) | — | — | — | — | 0.3 | 0.6 | — | — | — | — | — | — | — | — |
| Tetradec-1-ene ($C_{14}$ α-olefin) | — | — | 0.55 | 0.7 | — | — | — | — | — | — | 0.5 | — | — | — |
| Hexadec-1-ene ($C_{16}$ α-olefin) | — | — | — | — | — | — | — | — | — | — | — | 0.57 | — | — |
| Octadec-1-ene ($C_{18}$ α-olefin) | — | — | — | — | — | — | — | — | — | — | — | — | 0.64 | — |
| PIB (Polyisobutylene) | — | — | — | — | — | — | — | — | — | — | — | — | — | 2.42 |
| Seals Test | | | | | | | | | | | | | | |
| TS (%)** | −31 | −47 | −21 | −20 | −40 | −28 | −35 | −26 | −43 | −16 | −15 | −15 | −16 | −34 |
| EAB (%)*** | −54 | −62 | −47 | −46 | −59 | −53 | −56 | −50 | −63 | −42 | −40 | −41 | −41 | −56 |
| HTCBT | | | | | | | | | | | | | | |
| Copper ppm | 6 | 10 | 8 | 7 | 22 | 36 | 13 | 59 | — | — | — | — | — | — |
| Lead ppm | 8 | 10 | 14 | 8 | 4 | 3 | 4 | 5 | — | — | — | — | — | — |

*SRME is sulfurized rapeseed methyl ester,
**TS represents change in tensile stress,
***EAB represents elongation at break It is evident from the Seals Test and HTCBT results in Table 1 that the addition of a sulphur containing anti-oxidant (SRME) to Reference Lubricant 1 worsens nitrile seal compatibility and increases both copper and lead corrosion (compare Reference Lubricant 1 with Comparative Lubricants A and B).

The Seals Test data demonstrate that the addition of an alkene, particularly an alkene having greater than or equal to 10 carbon atoms, to a lubricant which includes a sulphur containing anti-oxidant (SRME) typically improves nitrile seal compatibility as evidenced by the results for change in tensile strength (TS) and elongation at break (EAB)—(compare Examples 1, 2, 5 and 6 with Comparative Lubricant A and compare Examples 7 to 10 with Comparative Lubricant B). Although the $C_{10}$ alk-1-ene improves nitrile seal compatibility (Compare Examples 5 and 6 with Comparative Lubricant A), it is evident at equal molar treat rates the $C_{14}$ alk-1-ene provides better results (compare TS and EAB results of Example 2 with those of Example 6). Furthermore, at equimolar treat rates of the respective alkene the $C_{12}$ to $C_{18}$ alk-1-enes improve nitrile seal compatibility significantly and essentially with equal affect (compare TS

Examples 11 to 13—Sulfurized Fatty Acid Ester

The lubricating oil compositions of Examples 17 to 19, as well as Reference Lubricant 2 (Ref 2) and Comparative Lubricant D, as detailed in Table 2, were each subjected to the Nitrile Elastomer Seal Compatibility Test (VDA 675 301) and the High Temperature Corrosion Bench Test (ASTM D6594-06). In addition to the additive components detailed in Table 2, each of the lubricating oil compositions of Examples 11 to 13, Comparative Lubricant D and Reference Lubricant 2 include identical amounts of the following identical components: dispersant; ZDDP; overbased sulfonate/phenate detergent; organo-molybdenum trimer (50 ppm molybdenum); aromatic amine anti-oxidant; and, viscosity modifier.

In the Examples, the sulphur containing anti-oxidant was a sulfurized fatty acid ester (Base 10SE available from Dover Chemicals), the alkene is tetradec-1-ene ($C_{14}$ α-olefin) available from Sigma Aldrich. The amount of each additive in each lubricating oil composition is expressed in terms of mass % on an active ingredient basis, based on the total mass of the lubricating oil composition. In Comparative Example D and Examples 11 to 13, the sulfurized fatty acid ester (Base 10 SE) provides 800 ppm of sulphur to each lubricating oil composition.

TABLE 2

| | Ref 2 | D | 11 | 12 | 13 |
|---|---|---|---|---|---|
| Base 10SE | — | 0.8 | 0.8 | 0.8 | 0.8 |
| Tetradec-1-ene | — | — | 0.25 | 0.5 | 1.0 |
| Seals Test | | | | | |
| TS (%)* | −6.7 | −19 | −11 | −4 | −2 |
| EAB (%)** | −19 | −31 | −24 | −20 | −8 |
| HTCBT | | | | | |
| Copper ppm | 8 | 14 | 9 | 10 | 7 |
| Lead ppm | 4 | 7 | 5 | 6 | 8 |

*TS represents change in tensile stress,
**EAB represents elongation at break

It is evident from the results in Table 2 that the addition of a sulphur containing anti-oxidant (Base 10SE) to the Reference Lubricant 2 worsens nitrile seal compatibility and increases both copper and lead corrosion (compare Reference Lubricant 2 with Comparative Lubricant D).

The Seals Test data demonstrate that the addition of the $C_{14}$ α-olefin (tetradec-1-ene), to a lubricant which includes a sulphur containing anti-oxidant (Base 10SE) improves nitrile seal compatibility as evidenced by the results for change in tensile strength (TS) and elongation at break (EAB)—(compare Examples 11 to 13 with Comparative Lubricant D). Furthermore, the improvement in nitrile seal compatibility is further improved by increasing the amount of alkene in the lubricant (compare Examples 11 to 13).

The HTCBT data demonstrate that the addition of an alkene, particularly an alkene having at least 14 carbon atoms, to a lubricant which includes a sulphur containing anti-oxidant (base 10SE) typically improves copper corrosion performance and/or lead corrosion performance (compare Examples 11 to 13 with Comparative Lubricant D).

Examples 14 to 18—Molybdenum Anti-Oxidant

Reference Lubricant 3 (Ref 3), Comparative Lubricant E and Lubricants 14 to 18, as detailed in Table 3, were each subjected to the Nitrile Elastomer Seal Compatibility Test (VDA 675 301). In addition to the additive components detailed in Table 3, each of the lubricating oil compositions of Examples 14 to 18, Comparative Lubricant E and Reference Lubricant 3 include identical amounts of the following identical components: dispersant; ZDDP; overbased sulfonate/phenate detergent; aromatic amine anti-oxidant; and, viscosity modifier.

A tri-nuclear molybdenum dithiocarbamate (MoT), available from Infineum UK Ltd, was used in Comparative Lubricant E and Lubricants 14 to 18 in an amount providing 200 ppm molybdenum and 360 ppm sulphur to the lubricant; the molybdenum trimer provided 90 ppm molybdenum to reference Lubricant 3. Tetradec-1-ene was used as the alkene.

TABLE 3

| | Ref 3 | E | 14 | 15 | 16 | 17 | 18 |
|---|---|---|---|---|---|---|---|
| MoT | 0.09 | 0.36 | 0.36 | 0.36 | 0.36 | 0.36 | 0.36 |
| Tetradecene | — | — | 0.1 | 0.3 | 0.5 | 0.7 | 1 |

TABLE 3-continued

| | Ref 3 | E | 14 | 15 | 16 | 17 | 18 |
|---|---|---|---|---|---|---|---|
| Seals Test | | | | | | | |
| TS (%)* | −7 | −34 | −15 | −8 | −6 | −4 | −8 |
| EAB (%)** | −19 | −49 | −28 | −20 | −20 | −19 | −19 |

*TS represents change in tensile stress,
**EAB represents elongation at break

It is evident from the Seals Test data in Table 3, that the addition of sulphur containing molybdenum compound to Reference Lubricant 3 significantly increases incompatibility with nitrile elastomer seals (compare Comparative Lubricant E with reference Lubricant 3). The incompatibility with nitrile elastomer seals of a lubricant containing such a sulphur containing molybdenum compound is alleviated by the inclusion of tetradec-1-ene in the lubricating oil composition (compare Lubricants 14 to 18 with Comparative Lubricant E).

Example 19—Sequence IIIG Engine Test

Reference Lubricant 4 (Ref 4), Comparative Lubricant F, and Lubricant 19, as detailed in Table 4, were each subjected to the Sequence IIIG Engine Test and the time taken for KV40 viscosity to increase by 50% measured (ASTM D445). In addition to the additive components detailed in Table 4, each of Reference Lubricant 4, Comparative Lubricant F, and Lubricant 19 include identical amounts of the following identical components: dispersant; ZDDP; overbased sulfonate detergent; aromatic amine anti-oxidant; and, viscosity modifier.

SRME (sulfurized rapeseed methyl ester (17% sulphur content)) was used as the sulphur containing anti-oxidant and in an amount providing the lubricant with 800 ppm sulphur, and tetradec-1-ene was used as the alkene.

TABLE 4

| | Ref 4 | F | 19 |
|---|---|---|---|
| SRME | — | 0.47 | 0.47 |
| Tetradec-1-ene | — | — | 0.7 |
| Sequence IIIG | | | |
| Time to +50% KV40 increase (hours) | 53 | 76 | 82 |

The data in Table 4 demonstrate that the addition of a sulphur containing anti-oxidant to the Reference Lubricant 4 increases the time taken for the viscosity (KV40) of the lubricant to increase by 50%, thereby indicating that the presence of the sulphur containing anti-oxidant improves the oxidative stability of the lubricant (compare Lubricant F with Reference Lubricant 4). The oxidative stability of the lubricant is further improved, as evidenced by a longer time to reach 50% KV40 increase, by the addition of a combination of the sulphur containing anti-oxidant and tetradec-1-ene (compare Lubricant 19 with Lubricant F and reference Lubricant 4).

The invention claimed is:

1. A lubricating oil composition which comprises or is made by admixing:

(A) an oil of lubricating viscosity, in a major amount;

(B) one or more oil-soluble or oil-dispersible sulphur containing anti-oxidant(s), as an additive in an effective minor amount providing the lubricating oil composition with greater than or equal to 0.01 mass % sulphur;

(C) one or more oil-soluble or oil-dispersible acyclic $C_{12}$ to $C_{22}$ alk-1-ene(s) having a single carbon to carbon double bond, as an additive in an effective minor amount of greater than or equal to 0.01 mass %, based on the total mass of the lubricating oil composition; and (E) one or more dihydrocarbyl dithiophosphate metal salt(s), as an additive in an effective minor amount providing the lubricating oil composition with no greater than 1200 ppm by mass of phosphorus, based on the total mass of the lubricating oil composition.

2. A composition as claimed in claim 1, wherein the one or more oil-soluble or oil-dispersible sulphur containing anti-oxidant(s) (B) is selected from: one or more sulfurized ($C_4$ to $C_{25}$) olefin(s); one or more sulphur containing phenolic anti-oxidants one or more one sulfurized aliphatic ($C_7$ to $C_{29}$) hydrocarbyl fatty acid ester(s); one or more sulphur containing molybdenum compound(s); and, combinations thereof.

3. A composition as claimed in claim 2, wherein the one or more sulphur containing anti-oxidants(s) (B) is one or more one sulfurized aliphatic ($C_7$ to $C_{29}$) hydrocarbyl fatty acid ($C_1$ to $C_{20}$) alkyl ester(s); one or more one sulfurized aliphatic ($C_7$ to $C_{29}$) hydrocarbyl fatty acid glycerol ester(s); and, combinations thereof.

4. A composition as claimed in claim 3, wherein the one or more sulphur containing anti-oxidants(s) (B) is one or more sulfurized aliphatic ($C_7$ to $C_{29}$) hydrocarbyl fatty acid methyl ester(s).

5. A composition as claimed in claim 2, wherein the one or more oil-soluble or oil-dispersible sulfurized aliphatic ($C_7$ to $C_{29}$) hydrocarbyl fatty acid ester(s) is derived from sulfurizing a vegetable oil and/or a trans-esterified product of a vegetable oil.

6. A composition as claimed in claim 5, wherein the one or more oil-soluble or oil-dispersible sulfurized aliphatic ($C_7$ to $C_{29}$) hydrocarbyl fatty acid ester(s) is derived from sulfurizing palm oil, corn oil, grapeseed oil, coconut oil, cottonseed oil, wheatgerm oil, soya oil, safflower oil, olive oil, peanut oil, rapeseed oil, sunflower oil, or a trans-esterified product thereof, and combinations thereof, especially rapeseed oil, palm oil or a trans-esterified product thereof, and combinations thereof.

7. A composition as claimed in claim 2, wherein the one or more sulfurized aliphatic ($C_7$ to $C_{29}$) hydrocarbyl fatty acid ester(s) has a sulphur content of from 5 to 30 mass %.

8. A composition as claimed in claim 2, wherein the one or more sulphur containing molybdenum compound(s) is one or more sulphur containing organo-molybdenum compound(s).

9. A composition as claimed in claim 1, wherein the sulphur containing anti-oxidant is present in an amount providing the lubricating oil composition with greater than or equal to 0.03 mass % sulphur.

10. A composition as claimed in claim 1, wherein the one or more oil-soluble or oil-dispersible acyclic $C_{12}$ to $C_{22}$ alk-1-ene(s) (C) is one or more acyclic $C_{12}$ to $C_{18}$ alk-1-ene(s).

11. A composition as claimed in claim 1, wherein the one or more oil-soluble or oil-dispersible acyclic $C_{12}$ to $C_{22}$ alk-1-ene(s) (C) is one or more linear acyclic $C_{12}$ to $C_{18}$ alk-1-ene(s).

12. A composition as claimed in claim 11, wherein the one or more oil-soluble or oil-dispersible linear acyclic $C_{12}$ to $C_{18}$ alk-1-ene(s) (C) comprises dodec-1-ene, tetradec-1-ene, hexadec-1-ene, octadec-1-ene, or combinations thereof.

13. A composition as claimed in claim 1, wherein the lubricating oil composition further includes one or more co-additives in an effective minor amount, other than additive components (B) and (C), selected from ashless dispersants, metal detergents, corrosion inhibitors, antioxidants, pour point depressants, anti-wear agents, friction modifiers, demulsifiers, antifoam agents and viscosity modifiers.

14. A method of lubricating a spark-ignited or compression-ignited internal combustion engine comprising lubricating the engine with a lubricating oil composition as claimed in claim 1.

* * * * *